US009388620B2

(12) United States Patent
Endo

(10) Patent No.: US 9,388,620 B2
(45) Date of Patent: Jul. 12, 2016

(54) DOOR STOPPER AND ROD LOCKING MECHANISM

(71) Applicant: MITSUBISHI STEEL MFG. CO., LTD., Tokyo (JP)

(72) Inventor: Takao Endo, Chiba (JP)

(73) Assignee: MITSUBISHI STEEL MFG. CO., LTD., Tokyo (JP)

( * ) Notice: Subject to any disclaimer, the term of this patent is extended or adjusted under 35 U.S.C. 154(b) by 0 days.

(21) Appl. No.: 14/771,235

(22) PCT Filed: Feb. 27, 2014

(86) PCT No.: PCT/JP2014/054894

§ 371 (c)(1),
(2) Date: Aug. 28, 2015

(87) PCT Pub. No.: WO2014/133086

PCT Pub. Date: Sep. 4, 2014

(65) Prior Publication Data

US 2016/0002967 A1 Jan. 7, 2016

(30) Foreign Application Priority Data

Mar. 1, 2013 (JP) ..... 2013-040394
May 24, 2013 (JP) ..... 2013-110072

(51) Int. Cl.
*E05F 5/08* (2006.01)
*E05C 17/52* (2006.01)
(Continued)

(52) U.S. Cl.
CPC . *E05F 5/08* (2013.01); *E05C 17/52* (2013.01); *E05C 19/022* (2013.01); *E05F 5/06* (2013.01); *Y10T 16/61* (2015.01)

(58) Field of Classification Search
CPC ..... Y10T 16/61; Y10T 16/625; Y10T 292/65; Y10T 292/67; Y10T 292/68; Y10T 292/71; Y10T 292/73; E05C 17/44; E05C 17/48; E05C 17/54; E05C 19/02; E05C 19/18; E05C 19/022; E05C 17/52; E05F 5/02; E05F 5/06; E05F 5/08; Y10S 292/15; Y10S 292/19
USPC ..... 16/82, 85; 292/338–340, 342, 343, 292/DIG. 15, DIG. 19
See application file for complete search history.

(56) References Cited

U.S. PATENT DOCUMENTS 1,509,780 A * 9/1924 Robertson ..... E05C 19/022 292/198
3,239,261 A * 3/1966 Bryson ..... E05C 17/48 292/341.18

(Continued)

FOREIGN PATENT DOCUMENTS

DE 1459198 12/1968
JP H10-252336 9/1998

(Continued)

OTHER PUBLICATIONS

International Search Report mailed on May 27, 2014.

*Primary Examiner* — William Miller
(74) *Attorney, Agent, or Firm* — IPUSA, PLLC

(57) ABSTRACT

The present invention is related to a door stopper including a rod mechanism attached to a door, the rod mechanism being provided with a rod extending toward a floor; and a rod locking mechanism provided on the floor, the rod locking mechanism being configured to lock the door in an open state by locking the rod, wherein the rod locking mechanism includes a locking member that is moveable along a floor surface, the locking member being configured to lock a movement of the rod by engaging with the rod according to a motion of the door in an opening direction for a first time, and to allow a movement of the rod in a closing direction of the door by releasing the engagement with the rod according to a motion of the door in the opening direction for a second time.

4 Claims, 21 Drawing Sheets

(51) Int. Cl.
*E05C 19/02* (2006.01)
*E05F 5/06* (2006.01)

(56) References Cited

U.S. PATENT DOCUMENTS 3,966,245 A * 6/1976 Losenno ..... E05C 17/50 292/202
4,421,348 A * 12/1983 Kahn ..... E05C 19/004 292/339
5,120,093 A * 6/1992 Carney ..... E05C 17/48 16/82
5,836,049 A * 11/1998 Chiang ..... E05C 17/50 16/82
5,983,680 A * 11/1999 Del Nin ..... E05C 17/38 16/82
6,161,252 A * 12/2000 Rodriguez ..... E05C 17/52 16/82
6,321,411 B1 * 11/2001 Ikejiri ..... E05C 17/56 16/82
6,345,849 B1 * 2/2002 Yen ..... E05C 17/54 292/292
6,471,264 B1 * 10/2002 Ryan ..... E05C 1/04 292/251.5

FOREIGN PATENT DOCUMENTS

JP 2000291311 A * 10/2000
JP 2002047851 A * 2/2002
JP 2004-131997 4/2004
JP 2005-344315 12/2005
JP 2009-167772 7/2009
JP 2010-196412 9/2010
JP 2010-281194 12/2010

* cited by examiner

DOOR STOPPER AND ROD LOCKING MECHANISM

TECHNICAL FIELD

The present invention relates to a door stopper and a rod locking mechanism, that can lock a door, etc., in an open state.

BACKGROUND ART

Conventionally, there is known a door stopper for locking a door in an open state. A door stopper is generally constituted by a hook member arranged on the door, and a protruding part that is arranged to be protruding from the floor surface or the wall surface and that can lock the hook.

The hook member is usually provided at a position at the bottom part of the door near the floor. Therefore, in order to use the door stopper to lock the door in an open state, the operator makes a low posture (bends lower) after opening the door, and engages the hook member provided on the door with the protruding part.

However, this operation is troublesome. Therefore, there is proposed a door stopper having a configuration in which the door is locked along with the motion of opening the door, and the lock is released by operating the door again (Patent Document 1). The door stopper disclosed in Patent document 1 has a configuration provided with a stopper movable body that can oscillate in the vertical and horizontal directions with respect to the floor surface, and includes a stopper fixed body that is arranged on the floor and that locks the door by engaging with the stopper movable body along with the movement of the door.

RELATED-ART DOCUMENT

Patent Document

Patent document 1: Japanese Laid-Open Patent Publication No. H10-252336

DISCLOSURE OF INVENTION

Problems to be Solved by the Invention

However, the door stopper disclosed in Patent Document 1 has a problem in that the stopper movable body protrudes horizontally from the door, and thus becomes an obstruction.

Furthermore, the door stopper disclosed in Patent Document 1 has another problem in that the stopper fixed body does not move, and therefore a groove part, which is provided for the stopper movable body to engage with the stopper fixed body, needs to be entirely exposed, and therefore the door stopper has a bad appearance and has low properties as a commercial product.

Means for Solving the Problems

The present intervention has an overall objective of providing an improved and useful door stopper and a rod locking mechanism for resolving the above problems of the conventional technology.

A more detailed objective of the present invention is to provide a door stopper and a rod locking mechanism, capable of making the size compact and improving the appearance.

For achieving the above objectives, the present invention is characterized by a door stopper including a rod mechanism attached to a door, the rod mechanism being provided with a rod extending toward a floor; and a rod locking mechanism provided on the floor, the rod locking mechanism being configured to lock the door in an open state by locking the rod, wherein the rod locking mechanism includes a locking member that is moveable along a floor surface, the locking member being configured to lock a movement of the rod by engaging with the rod according to a motion of the door in an opening direction for a first time, and to allow a movement of the rod in a closing direction of the door by releasing the engagement with the rod according to a motion of the door in the opening direction for a second time, the locking member including a substantially heart-shaped pathway through which the rod passes, and the pathway including an engaging unit configured to engage with the rod and restrict the movement of the rod.

Advantageous Effect of the Invention

According to the present invention, a rod is locked by a cam that is movable along a floor surface, and the movement of the door is restricted, and therefore the rod locking mechanism can be made compact.

EXPLANATION OF REFERENCE NUMERALS

Figure 1:
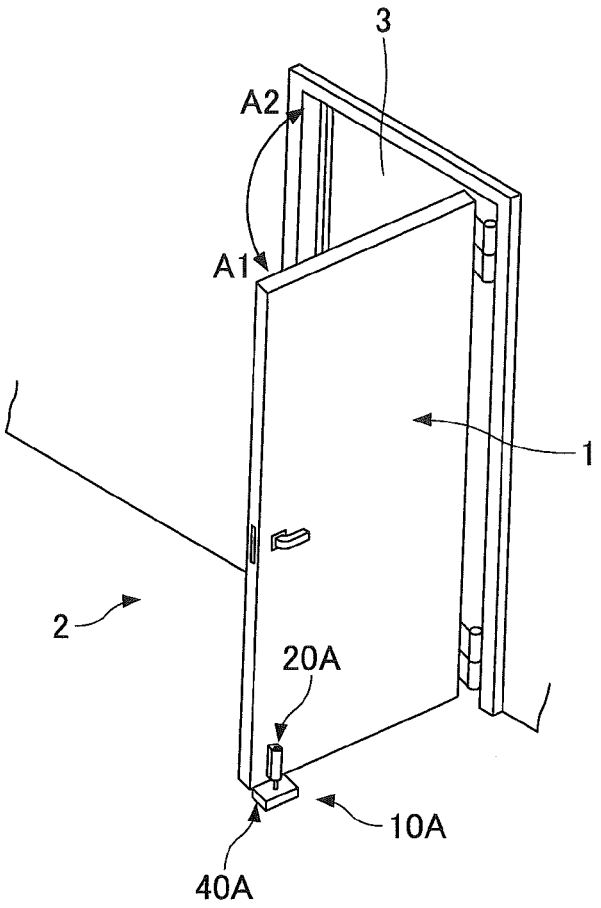
FIG. 1 is a perspective view of a mounted state of a door stopper according to a first embodiment of the present invention.

1 door
2 floor
10A, 10B, 10C, 10D door stopper
20A, 20B rod mechanism
21 case
22 rod
24 coil spring
40A, 40B, 40C, 40D rod locking mechanism
41 cam cover
42 base
43A, 43B, 43C, 43D cam member
44 cam holder
44*a* slide surface
45, 46 cam spring
48A, 48B, 48C, 48D rod pathway
49A upper protruding part
49B lower protruding part
50 rod insertion groove
51 frame part
54, 55 rod entering
56 enter pathway
57 engagement part
57*a* enter pathway side end part
57*b* return pathway side end part
58 return pathway
60 ratchet rod
62 plate spring
63 fixing screw
64 attachment hole
70 gear part
80 rod insertion guide unit
81, 82 guide surface
P rod pathway end part

DESCRIPTION OF EMBODIMENTS

Embodiments of the present invention are described below with reference to the accompanying drawings.

A door stopper 10A according to an embodiment of the present invention is for locking a door 1 in an open state, as illustrated in FIG. 1. As illustrated in an enlarged state in FIG. 2, the door stopper 10A is constituted by a rod mechanism 20A provided on the door 1 and a rod locking mechanism 40A provided on a floor 2.

Figure 3A:
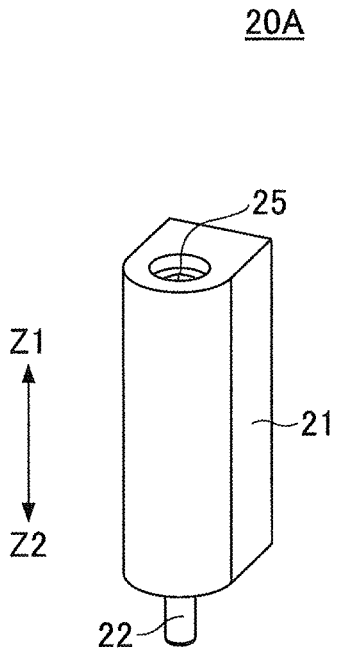
FIG. 3A is a perspective view of a rod mechanism constituting the door stopper according to the first embodiment of the present invention.
Figure 3B:
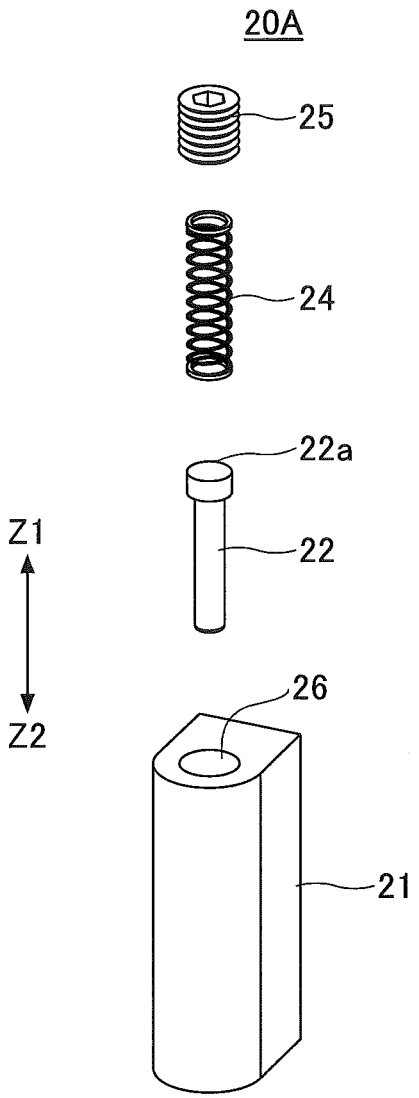
FIG. 3B is an exploded perspective view of the rod mechanism constituting the door stopper according to the first embodiment of the present invention.

As illustrated in an enlarged state in FIGS. 3A and 3B, the rod mechanism 20A includes a case 21, a rod 22, a coil spring 24, and a fixing screw 25. Note that FIG. 3A is a perspective view illustrating the exterior of the rod mechanism 20A, and FIG. 3B is an exploded perspective view of the rod mechanism 20A.

Figure 2:
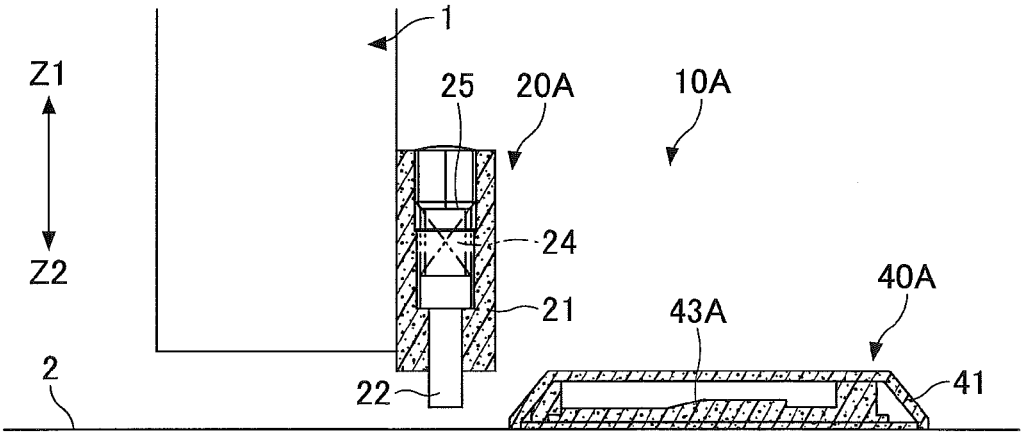
FIG. 2 is a side view of a mounted state of the door stopper according to the first embodiment of the present invention.

The case 21 is provided with a mounting hole 26 for mounting the rod 22. As illustrated in FIG. 2, the mounting hole 26 is a stepped hole. Furthermore, a predetermined range at the top part of the mounting hole 26 corresponds to a screw hole.

The rod 22 is engaged with the rod locking mechanism 40A as described below, and accordingly, the door 1 is locked in an open state. At the top end of the rod 22, a head part 22*a* is formed, which has a large diameter. The head part 22*a* has a configuration of engaging with the step part of the mounting hole 26, and accordingly, the rod 22 is prevented from coming out of the case 21.

Furthermore, after the rod 22 is inserted in the mounting hole 26, the coil spring 24 is inserted on the top part of the rod 22. Furthermore, the top end part of the coil spring 24 is fixed by screwing the fixing screw 25 into the screw hole of the mounting hole 26. Therefore, in a state where the rod 22, the coil spring 24, and the fixing screw 25 are mounted to the case 21, the rod 22 can move in a vertical direction (directions indicated by Z1, Z2 in the drawing) with respect to the case 21.

The rod mechanism 20A having the above configuration is fixed to the door 1 such that the movement direction of the rod 22 becomes orthogonal (vertical) with respect to the floor 2. The method of fixing the rod mechanism 20A to the door 1 is not particularly limited, but one example is to fix the rod mechanism 20A by using a fixing screw (not shown).

In a state where the rod mechanism 20A is attached to the door 1, the rod 22 extends toward the floor 2 from the case 21. Furthermore, the rod 22 is biased downward from the case 21 by the coil spring 24.

Furthermore, in a state where the rod mechanism 20A is attached to the door 1, the bottom end part of the rod 22 is spaced apart from the floor 2. However, the rod 22 has a height by which it is possible to engage with the rod locking mechanism 40A described below.

Figure 4:
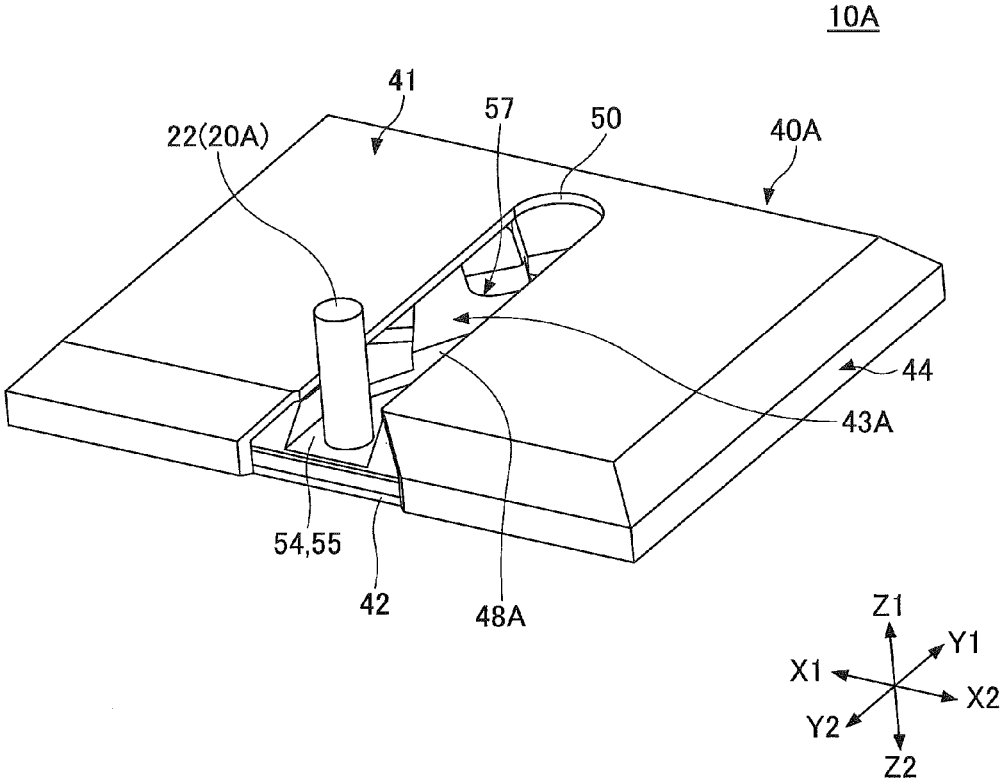
FIG. 4 is an exploded perspective view of a rod locking mechanism constituting the door stopper according to the first embodiment of the present invention.
Figure 5:
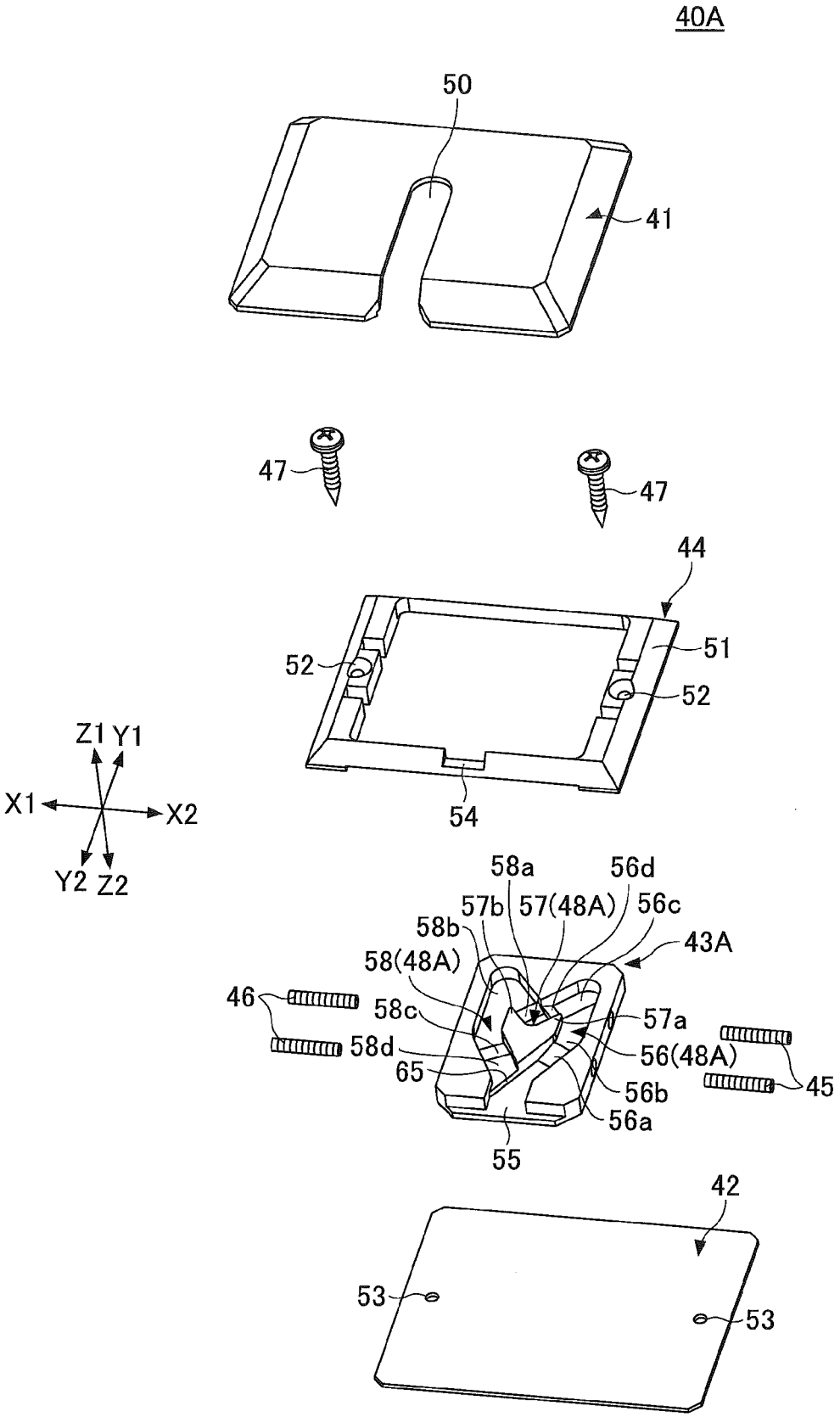
FIG. 5 is an exploded perspective view of a rod locking mechanism constituting the door stopper according to the first embodiment of the present invention.

Next, with reference to FIGS. 4 and 5, a description is given of the rod locking mechanism 40A. Note that FIG. 4 is a perspective view illustrating the exterior of the rod locking mechanism 40A, and FIG. 5 is an exploded perspective view of the rod locking mechanism 40A.

The rod locking mechanism 40A includes a cam cover 41, a base 42, a cam member 43A, a cam holder 44, etc.

At the center position of the cam cover 41, there is formed a rod insertion groove 50 that extends in the entering direction of the rod 22 (Y1, Y2 arrow direction). As described below, when locking the door 1 with the door stopper 10A, the rod 22 provided in the rod mechanism 20A fixed to the door 1, enters inside the rod insertion groove 50.

The base 42 is a plate-like member, and is arranged at the bottommost part of the rod locking mechanism 40A. The shape of the base 42 corresponds to the shape of the cam cover 41. In the space formed inside the cam cover 41 and the base 42, the cam member 43A and the cam holder 44 are accommodated.

In the cam member 43A, a rod pathway 48A is formed, along which the rod 22 proceeds. This rod pathway 48A includes a rod entering part 55, an enter pathway 56, an engagement part 57, and a return pathway 58.

Furthermore, the rod entering part 55, the enter pathway 56, the engagement part 57, and the return pathway 58 constituting the rod pathway 48A substantially form a heart shape as a whole. Furthermore, the inner part of the rod pathway 48A has a protruding part formed therein, which protrudes from the rod pathway 48A. Note that the rod pathway 48A is constituted such that when the rod 22 proceeds inside the rod pathway 48A, the rod 22 is prevented from proceeding in the wrong way.

The enter pathway 56 is formed between the rod entering part 55 where the rod 22 of the rod mechanism 20A enters and ejects, and the engagement part 57 with which the rod 22 engages. When the door 1 makes a motion in the opening direction for the first time, the rod 22 moves toward the engagement part 57 (in the Y1 arrow direction) inside the enter pathway 56.

The enter pathway 56 includes, from the rod entering part 55 side, a rising surface part 56*a*, a plain surface part 56*b*, a recessed surface part 56*c*, and a rising surface part 56*d*.

The rising surface part 56*a* is a slope surface extending in an oblique upward direction from the rod entering part 55. The upper side rim part of the rising surface part 56*a* is connected to the end part on the Y2 arrow side of the plain surface part 56*b*. Furthermore, the end part on the Y1 arrow side of the plain surface part 56*b* is connected to one end part of the recessed surface part 56*c*. The recessed surface part 56*c* is formed at a lower position than that of the plain surface part 56*b*, and a step part is formed between the plain surface part 56*b* and the recessed surface part 56*c*.

Furthermore, the other end part of the recessed surface part 56*c* is connected to the lower end part of the rising surface part 56*d*. The rising surface part 56*d* is a slope surface extending an oblique upward direction, and the upper side end part thereof is connected to the engagement part 57.

Note that the height of the end part of the rising surface part 56*d* on the side of the engagement part 57 is lower than the height of the engagement part 57. Therefore, between the upper side end part of the rising surface part 56*d* and the engagement part 57, a step part is formed.

The plan view of this enter pathway 56 has a shape that first extends in the oblique right direction (X2 arrow direction) in the Y1 arrow direction from the rod entering part 55, and then extends in the Y1 arrow direction in a linear manner.

The engagement part 57 has a configuration of engaging with the rod 22 that approaches by proceeding inside the rod pathway 48A. That is, a curved shape part is formed between an enter pathway side end part 57*a* and a return pathway side end part 57*b* of the engagement part 57, and this curved shape is set according to the diameter of the rod 22.

Furthermore, the height of the engagement part 57 is lower than the height of the rising surface part 56*d* on the engagement part 57 side, and is also lower than the height of a recessed surface part 58*b* described below. Therefore, when the rod 22 proceeds inside the engagement part 57, the rod 22 turns into a locked state by the engagement part 57.

Note that when the rod 22 engages with the engagement part 57, the rod 22 does not move backward to the enter pathway 56, because a step is formed between the engagement part 57 and the rising surface part 56*d*.

The return pathway 58 is formed between the engagement part 57 and the rod entering part 55. When the door 1 makes a motion in the opening direction for the second time, the rod 22 moves toward the rod entering part 55 (in the Y2 arrow direction) inside this return pathway 58.

The return pathway 58 includes, from the engagement part 57 side, a rising surface part 58*a*, a recessed surface part 58*b*, a rising surface part 56*c*, and a plain surface part 58*d*.

The rising surface part 58*a* is a slope surface extending in an oblique upward direction from the engagement part 57. The upper side rim part of the rising surface part 58*a* is connected to one end part of the recessed surface part 58*b*. The recessed surface part 58*b* is lower than the height of the upper side rim part of the rising surface part 58*a*, and a step is formed between the recessed surface part 58*b* and the upper side rim part of the rising surface part 58*a*.

Furthermore, the end part of the recessed surface part 58*b* in on the Y2 arrow side is connected to the bottom side end part of the rising surface part 56*c*. The rising surface part 56*c* is a slope surface extending in an oblique upward direction from the recessed surface part 58*b*. The upper side rim part of the rising surface part 58*c* is connected to the end part of the plain surface part 58*d* on the Y1 arrow direction side.

Furthermore, the end part of the plain surface part 58*d* on the Y2 arrow direction side is connected to the rod entering part 55. Here, the plain surface part 58*d* is set to be higher than the height of the rod entering part 55. Therefore, a step part 65 is formed between the rod entering part 55 and the plain surface part 58*d*.

When the door 1 makes a motion in the opening direction for the second time, the rod 22 which has been engaged with the engagement part 57 proceeds to climb the rising surface part 58*a*. Accordingly, the rod 22 reaches the return pathway 58. Note that specific motions of a door stopper 10A are described below.

The cam holder 44 has a frame shape, and includes a rod entering part 54 through which the rod 22 passes. The cam member 43A is mounted inside this cam holder 44. In this mounted state, as the rod 22 proceeds, the rod 22 pushes the cam member 43A, such that the cam member 43A moves by sliding inside the cam holder 44 in the X1, X2 arrow direction in the figure. This sliding movement is performed by sliding on the base 42.

Furthermore, between the cam member 43A and the cam holder 44, cam springs 45, 46 are mounted. The cam spring 45 is arranged between the side surface of the cam member 43A on the X2 arrow direction side and the cam holder 44. Furthermore, the cam spring 46 is arranged between the side surface of the cam member 43A on the X1 arrow direction side and the cam holder 44.

Therefore, when the cam member 43A moves inside the cam holder 44 in the X1 arrow direction, the cam spring 46 contracts, and an elastic force of moving and biasing the cam member 43A in the X2 arrow direction is generated. Furthermore, when the cam member 43A moves inside the cam holder 44 in the X2 arrow direction, the cam spring 45 contracts, and an elastic force of moving and biasing the cam member 43A in the X1 arrow direction is generated.

In order to attach the rod locking mechanism 40A having the above configuration on the floor 2, the cam member 43A and the cam springs 45, 46 are incorporated between the base 42 and the cam holder 44, and then an attaching screw 47 is used to fix the cam holder 44 and the base 42 onto the floor 2. Note that the cam member 43A and the cam springs 45, 46 may be incorporated after fixing the cam holder 44 and the base 42 onto the floor 2.

In the cam holder 44, an insertion hole 52 is formed, and in the base 42, an insertion hole 53 is formed. Thus, by screwing the attaching screw 47 into the floor 2 via the insertion hole 52 and the insertion hole 53, the base 42 and the cam holder 44 are fixed to the floor 2.

The cam cover 41 can be fit along the outer periphery of the cam holder 44. Thus, after fixing the base 42, the cam holder 44, etc., on the floor 2, the cam cover 41 is fit onto the cam holder 44. Accordingly, the rod locking mechanism 40A is fixed to the floor 2. Note that the position of attaching the rod locking mechanism 40A on the floor 2 is set at the position at which the door 1 is to be locked on the floor 2.

Next, a description is given of the motion of the door stopper 10A having the above configuration.

FIGS. 6A through 6D are diagrams for describing the motion of the door stopper 10A. Note that in FIGS. 6A through 6D, as a matter of convenience in illustration and description, with respect to the rod mechanism 20A, only the rod 22 is illustrated, and with respect to the rod locking mechanism 40A, the cam cover 41 and the base 42 are omitted from being illustrated.

Figure 6A:
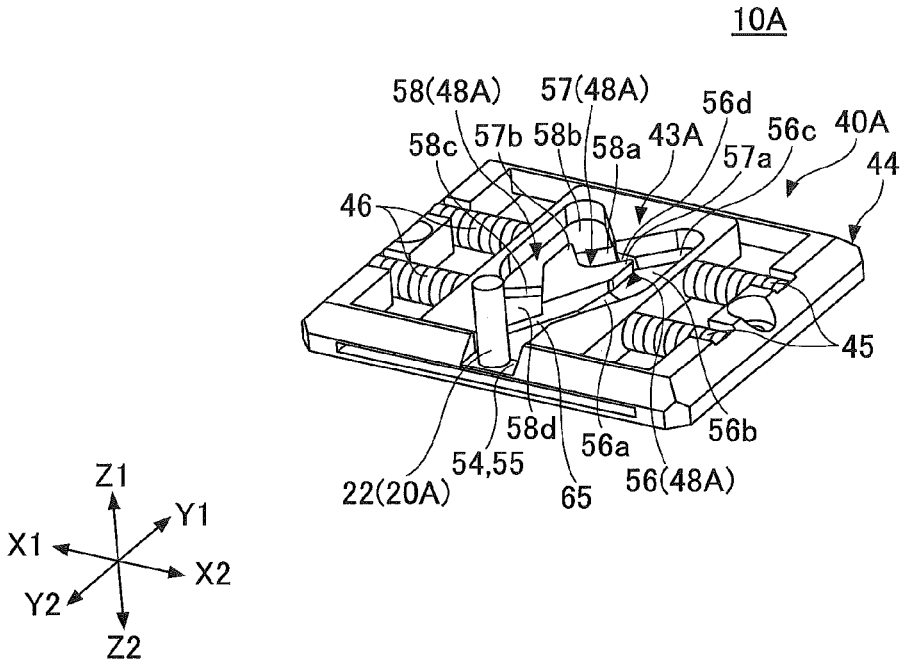
FIG. 6A is a diagram for describing the motion of the door stopper according to the first embodiment of the present invention.

FIG. 6A illustrates a state where the rod 22 is positioned at the rod entering part 54 of the rod locking mechanism 40A, as the door 1 makes a motion in the opening direction for the first time (hereinafter, this state is referred to as a "free state"). Here, the "door 1 making a motion in the opening direction for the first time" means a motion of opening the door 1 and also locking the door 1 with the door stopper 10A. Furthermore, the "opening direction" is the direction in which the door 1 is opened from a state where an entrance 3 is closed, which is the direction indicated by the arrow A1 in FIG. 1.

The free state is a state in which the rod 22 has not yet proceeded along the rod pathway 48A. In this free state, the cam springs 45, 46 are in an equal state, and therefore the cam member 43A is positioned at the center inside the cam holder 44. In this state, the rod entering part 55 of the cam member 43A is held at a position that matches the rod entering part 54 of the cam holder 44 and the rod insertion groove 50 of the cam cover 41.

Figure 6B:
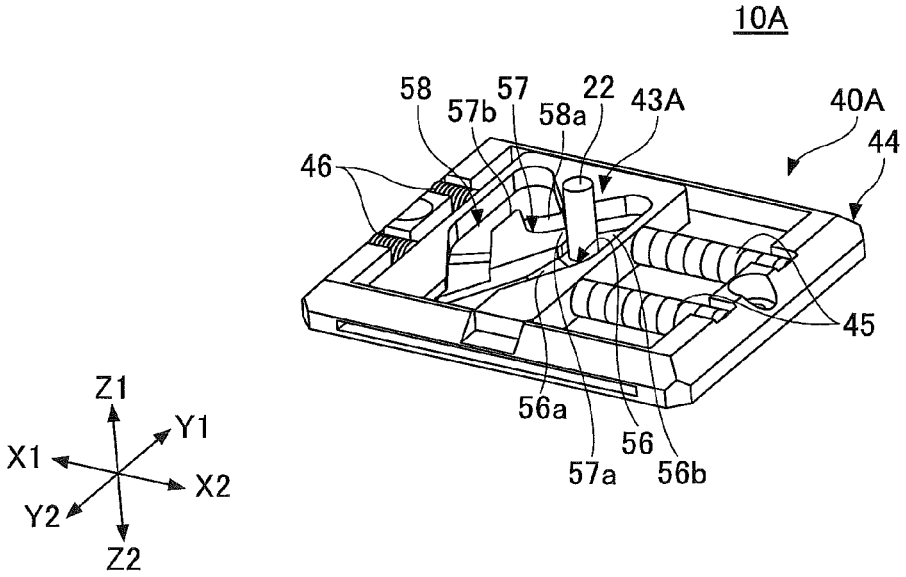
FIG. 6B is a diagram for describing the motion of the door stopper according to the first embodiment of the present invention.

When the door 1 is moved further in the opening direction from the free state, as illustrated in FIG. 6B, the rod 22 moves in the Y1 arrow direction along the enter pathway 56 constituting the rod pathway 48A. FIG. 6B illustrates a state where the rod 22 has climbed along the rising surface part 56*a*, and has proceeded to the plain surface part 56*b*.

Here, the step part 65 is formed between the rod entering part 55 and the end part of the return pathway 58 (plain surface part 58*d*) in the Y2 arrow direction side as described above, and therefore when the door 1 makes a motion in the opening direction for the first time, the rod 22 does not proceed to the return pathway 58.

The rod 22 is also guided by the rod insertion groove 50 formed in the cam cover 41, and therefore as the rod 22 proceeds inside the enter pathway 56, the cam member 43A moves in the X1 arrow direction in the figure. Therefore, the cam spring 46 contracts, and thus an elastic force of moving and biasing in the X2 arrow direction is applied on the cam member 43A by the cam spring 46.

When the rod 22 further proceeds in the Y1 arrow direction from the state illustrated in FIG. 6B, the rod 22 falls into the recessed surface part 56*c* from the plain surface part 56*b*. The cam member 43A is biased to move in the X2 arrow direction by the cam spring 46, and therefore the rod 22 climbs the rising surface part 56*d* by this biasing force, and when the rod 22 climbs to the top of the rising surface part 56*d*, the rod 22 passes the enter pathway side end part 57*a* and engages with the engagement part 57.

Figure 6C:
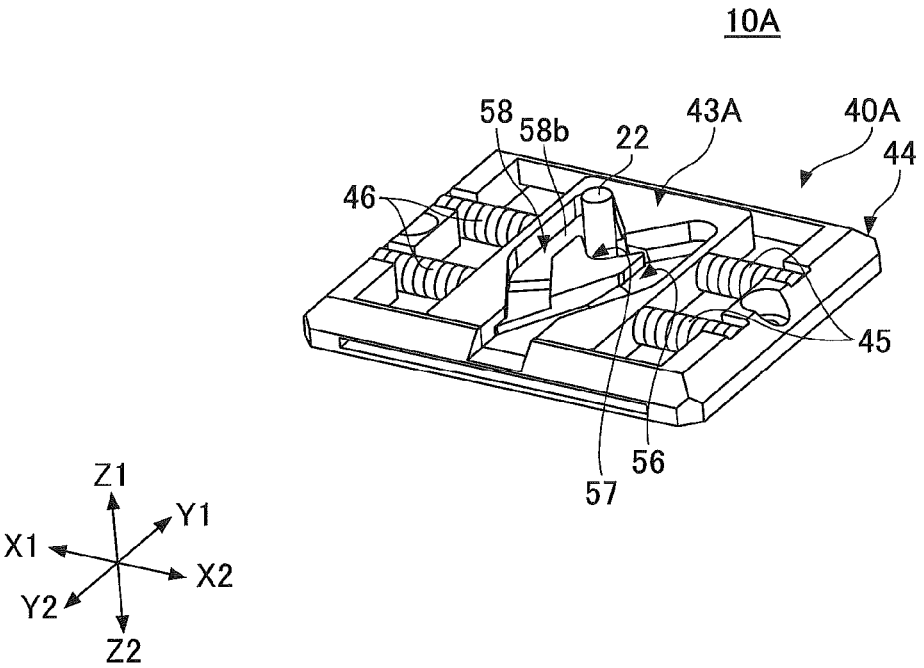
FIG. 6C is a diagram for describing the motion of the door stopper according to the first embodiment of the present invention.

FIG. 6C illustrates a state where the rod 22 and the engagement part 57 are engaged. The engagement part 57 is lower than the height of the upper side rim part of the rising surface part 56*d* constituting the enter pathway 56, and is also lower than the height of the upper side rim part of the rising surface part 58*a* constituting the return pathway 58. Thus, the movement of the rod 22 is restricted by the pair of rising surface parts 56*d*, 58*a*. Accordingly, the movement of the rod 22 in the engagement part 57 in the X1, X2 arrow direction is restricted.

Furthermore, when the door 1 makes a motion in the Y2 arrow direction (motion of the door 1 in the closing direction), a force in the closing direction (Y2 arrow direction) is applied to the rod 22. However, on the Y2 arrow direction side of the engagement part 57 of the cam member 43A, the protruding part is formed. By this protruding part, the movement of the rod 22 in the Y2 arrow direction is restricted, and therefore even if a force in the closing direction (Y2 arrow direction) is applied, the door 1 does not close and maintains an open state (hereinafter, this state is referred to as a "locked state").

In order to release this locked state and close the door 1, the door 1 is moved in the opening direction (Y1 arrow direction) (this motion is referred to as the "door 1 making a motion in the opening direction for the second time").

Figure 6D:
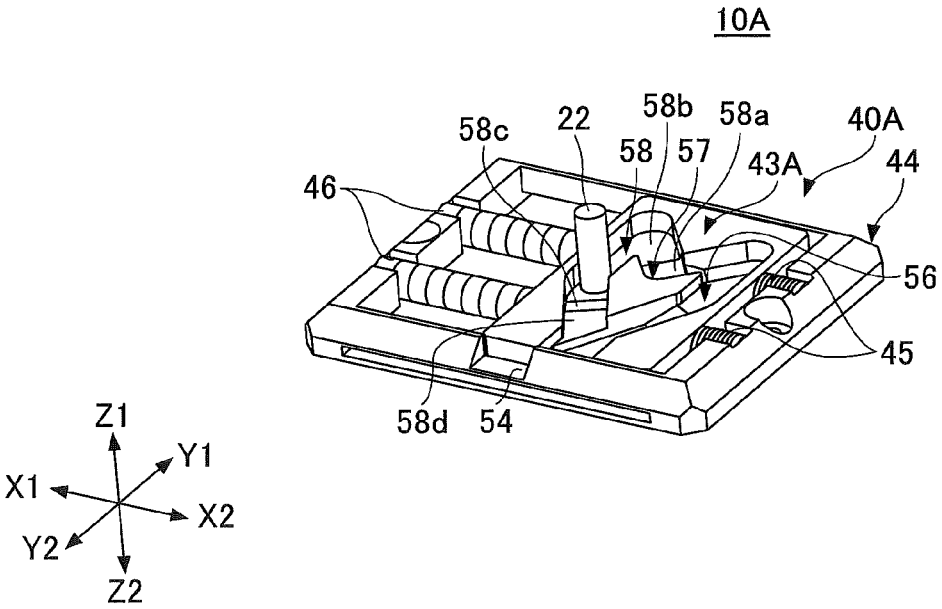
FIG. 6D is a diagram for describing the motion of the door stopper according to the first embodiment of the present invention.

By moving the door 1 in the opening direction (Y1 arrow direction) as described above, the rod 22 proceeds to the return pathway 58. Specifically, the rod 22 climbs the rising surface part 58*a*, and after climbing to the top of the rising surface part 58*a*, the rod 22 falls into the recessed surface part 58*b*. Accordingly, the rod 22 separates from the engagement part 57 and the return pathway side end part 57*b*, and the engagement between the rod 22 and the engagement part 57 is released. FIG. 6D illustrates a state where rod 22 is moving inside the return pathway 58 in the Y2 arrow direction.

Note that between the engagement part 57 and the rising surface part 56*d*, a step is formed as described above, and therefore the rod 22 does not move backward to the enter pathway 56 side as the door makes a motion in the opening direction for the second time.

When closing the door 1, a force is loaded on the door 1 in the closing direction (direction indicated by A2 arrow in FIG. 1). This force is also loaded on the rod 22, and therefore the rod 22 moves inside the return pathway 58 in the Y2 arrow direction. Specifically, the rod 22 proceeds along the recessed surface part 58*b* in the Y2 arrow direction, and then climbs the rising surface part 58*c*, and reaches the plain surface part 58*d*. Then, as the rod 22 further moves along the plain surface part 58*d* in the Y2 arrow direction, the rod 22 separates from the plain surface part 58*d* and falls into the rod entering part 55 that is lower than the plain surface part 58*d*.

In a state where the rod 22 has moved near the rod entering part 54, the cam member 43A also moves to a substantially center position, and the rod entering part 54 and the rod entering part 55 match each other and are communicated with each other. Thus, as the rod 22 further moves in the Y2 arrow direction, the rod 22 (rod mechanism 20A) separates from the rod locking mechanism 40A. Accordingly, the series of locking motions of the door 1 by the door stopper 10A are ended.

As described above, the door stopper 10A according to the present embodiment has a configuration in which the rod 22 is guided by the rod insertion groove 50 and moves substantially linearly in the Y1, Y2 arrow direction, whereas the cam member 43A slides in the X1, X2 arrow direction along the floor 2, and accordingly, the rod 22 is locked.

As described above, in the door stopper 10A according to the present embodiment, the rod mechanism 20A does not need to slide in the X arrow direction, and therefore the protruding amount of the rod mechanism 20A in the horizontal direction can be small with respect to the door 1, and can prevent a situation where the rod mechanism 20A becomes an obstruction in opening and closing the door 1.

Furthermore, as the cam member 43A moves in parallel with the floor 2, the rod locking mechanism 40A can have a flat shape. Thus, when the rod locking mechanism 40A is arranged on the floor 2, the protruding amount of the rod locking mechanism 40A from the floor 2 can be small.

Next, a description is given of other embodiments of the present invention.

FIGS. 7 through 10, FIG. 11A, FIG. 11B, FIGS. 15A through 15F, FIG. 17A, and FIG. 17B are diagrams for describing other embodiments of the present invention. Note that in these respective diagrams for describing other embodiments, the configurations corresponding to those indicated in FIG. 1, FIG. 2, FIG. 3A, FIG. 3B, FIG. 4, FIG. 5, FIGS. 6A through 6D used for describing the first embodiment are denoted by the same reference numerals and descriptions thereof are omitted.

FIGS. 7 through 10 illustrate a door stopper 10B according to a second embodiment. The door stopper 10B according to the present embodiment also uses a substantially heart-shaped rod pathway 48B as a cam member 43B (locking member), and the rod 22 and the cam member 43B constitute a cam mechanism.

The door stopper 10A according to the first embodiment described above has a configuration in which the height of the engagement part 57 is lower than the height of the end part of the enter pathway 56 in the Y1 arrow direction, and the step formed by this configuration prevents the rod 22 from returning to the enter pathway 56, as a configuration for preventing the rod 22 engaged with the engagement part 57 from returning to the enter pathway 56.

Meanwhile, the door stopper 10B according to the present embodiment is characterized in that the enter pathway 56, the engagement part 57, and the return pathway 58 formed in the cam member 43B have the same height. Therefore, in the present embodiment, the enter pathway side end part 57*a* and the return pathway side end part 57*b* of the engagement part 57 are asymmetrical. Specifically, the extending amount of the return pathway side end part 57*b* in the Y1 arrow direction is set to be larger than the extending amount of the enter pathway side end part 57*a* in the Y1 arrow direction. In the following, a description is given of the door stopper 10B having the above configuration.

Figure 7:
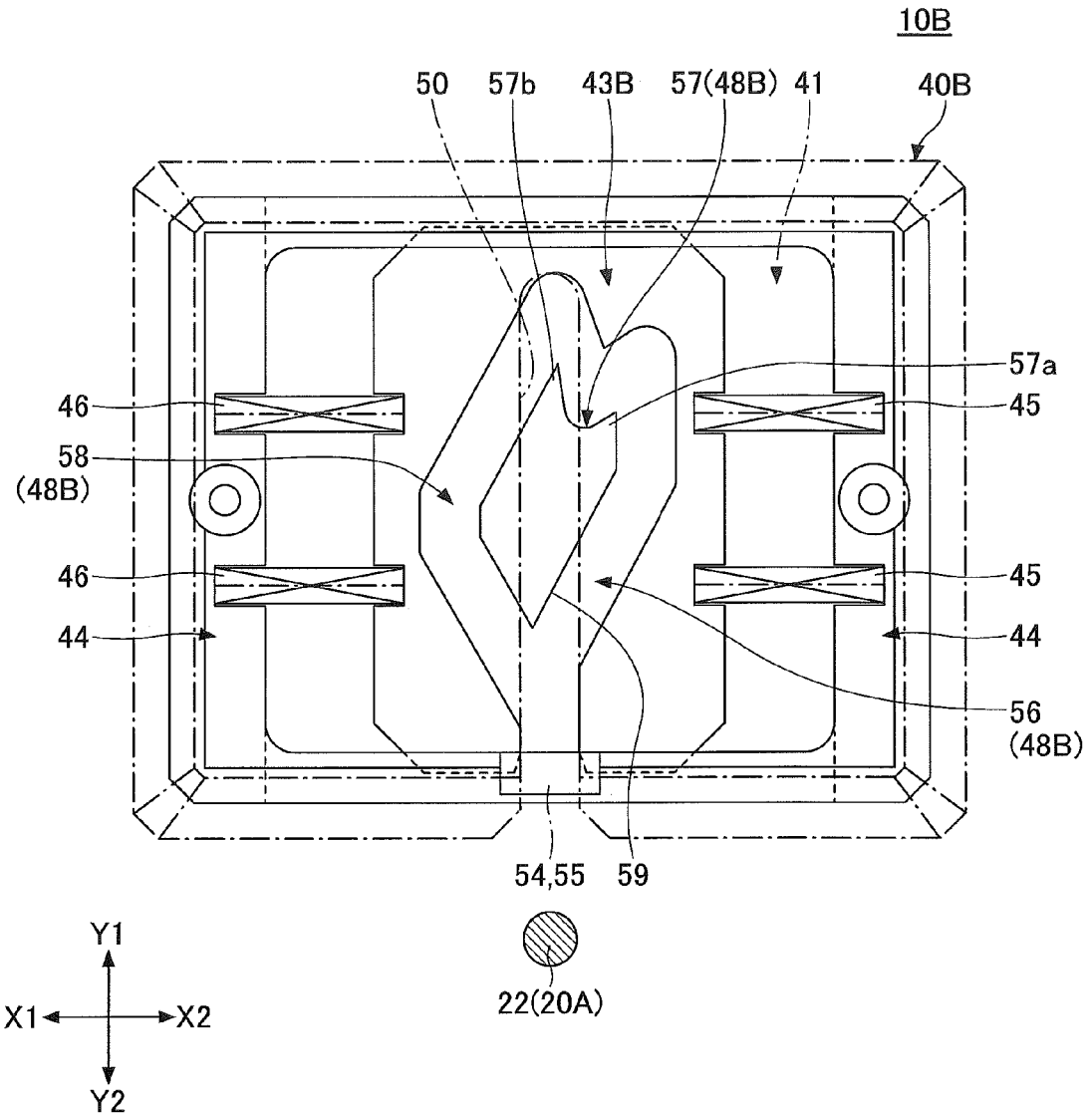
FIG. 7 is a diagram for describing the motion of a door stopper according to a second embodiment of the present invention.

FIG. 7 illustrates the free state of the door stopper 10B according to the present embodiment. In this free state, the cam springs 45, 46 are in an equal state. Thus, the cam member 43B is positioned at the center inside the cam holder 44, and the rod entering part 55 of the cam member 43B is held at a position that matches the rod entering part 54 of the cam holder 44 and the rod insertion groove 50 of the cam cover 41.

However, in the present embodiment, in the free state, a sloped wall 59 constituting the enter pathway 56 is positioned inside the rod insertion groove 50. Thus, when the door 1 is moved in the opening direction from the free state, the rod 22 that is guided by the sloped wall 59 proceeds along the enter pathway 56 as illustrated in FIG. 8.

As the rod 22 proceeds along the enter pathway 56, the cam member 43B moves in the X1 direction in the figure. Thus, an elastic force of moving and biasing in the X2 arrow direction is loaded on the cam member 43B by the cam spring 46.

Figure 8:
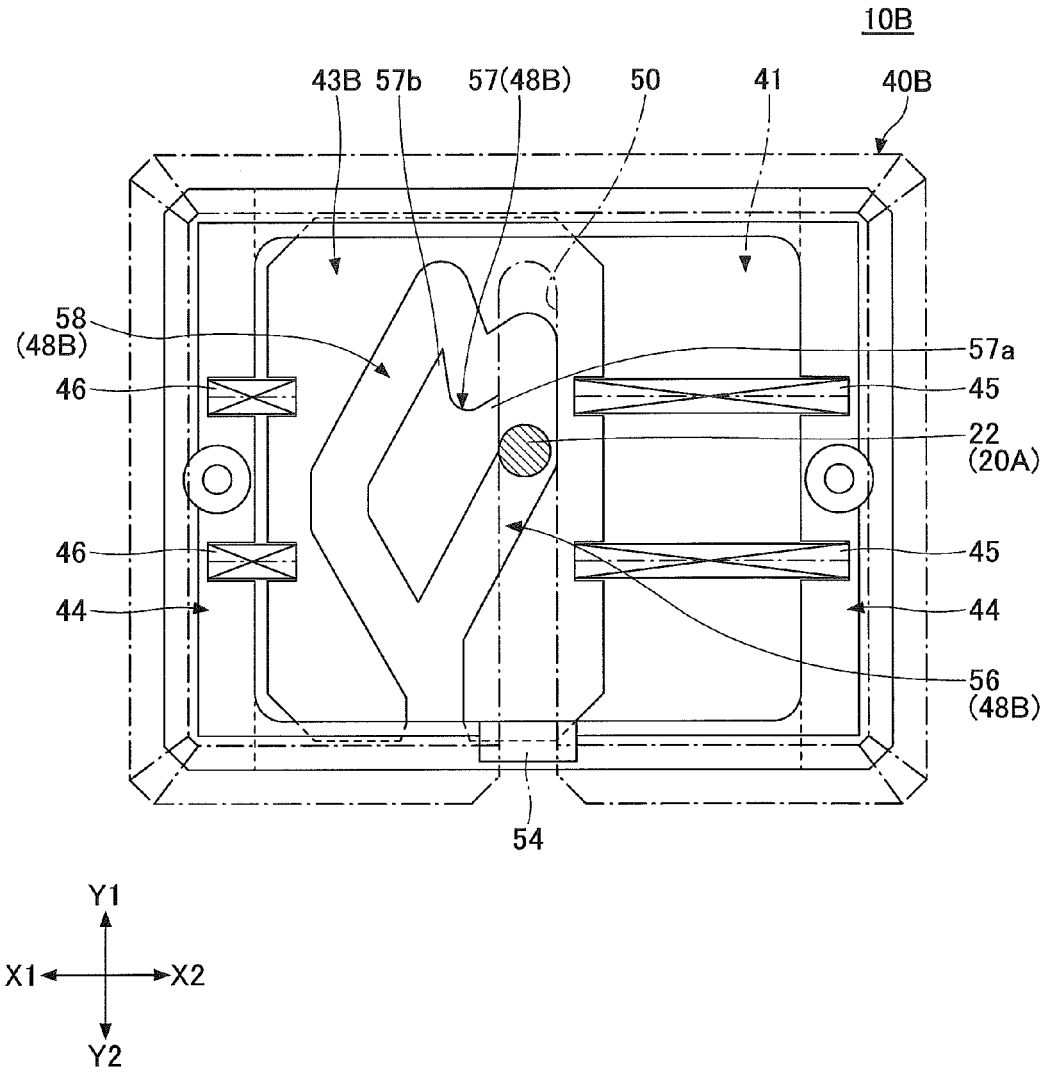
FIG. 8 is a diagram for describing the motion of the door stopper according to the second embodiment of the present invention.

When the rod 22 further proceeds in the Y1 arrow direction from the state illustrated in FIG. 8, eventually the rod 22 passes the enter pathway side end part 57*a* of the engagement part 57. As described above, the cam member 43A is biased to move in the X2 arrow direction by the cam spring 46.

Thus, as the rod 22 passes over the enter pathway side end part 57*a*, the cam member 43B moves in the X2 arrow direction. As described above, as the cam member 43B moves in the X2 arrow direction, the rod 22 relatively moves in the X1 arrow direction with respect to the cam member 43B.

However, in the present embodiment, as described above, the extending amount of the return pathway side end part 57*b* in the Y1 arrow direction is set to be larger than the extending amount of the enter pathway side end part 57*a* in the Y1 arrow direction. Thus, the rod 22 that has passed over the enter pathway side end part 57*a*, comes in contact with the return pathway side end part 57*b*, and does not immediately proceed to the return pathway 58. Thus, the rod 22 that has passed over the enter pathway side end part 57*a* surely engages with the engagement part 57.

Figure 9:
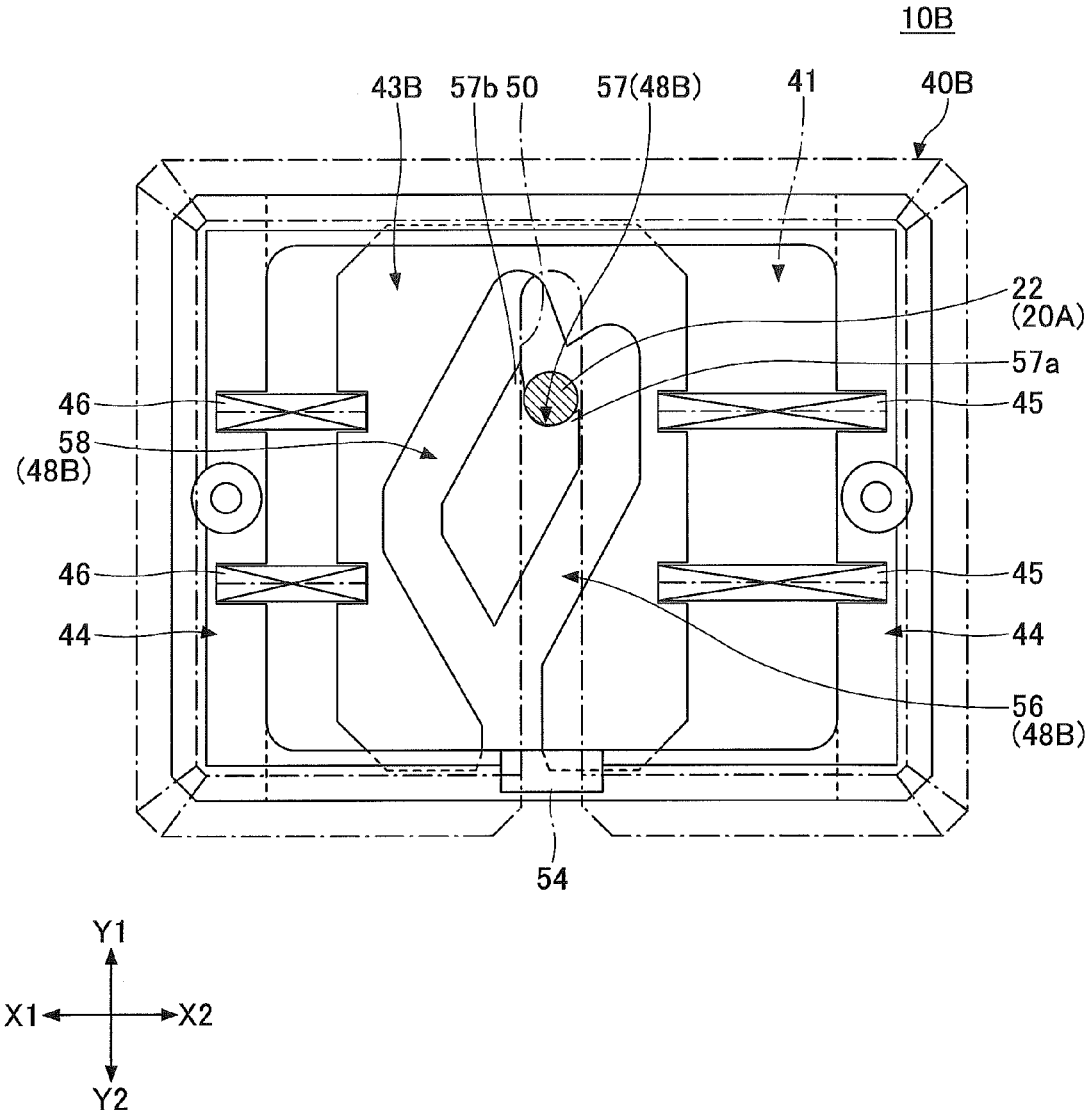
FIG. 9 is a diagram for describing the motion of the door stopper according to the second embodiment of the present invention.

FIG. 9 illustrates a state where the rod 22 and the engagement part 57 are engaged. As the rod 22 and the engagement part 57 engage as illustrated, the door 1 is locked in an open state (locked state) by the door stopper 10B. In this engagement state, the position of the cam member 43B is still closer toward one side in the X1 arrow direction from the center. That is, the cam member 43A is biased to move in the X2 arrow direction by the cam spring 46.

Figure 10:
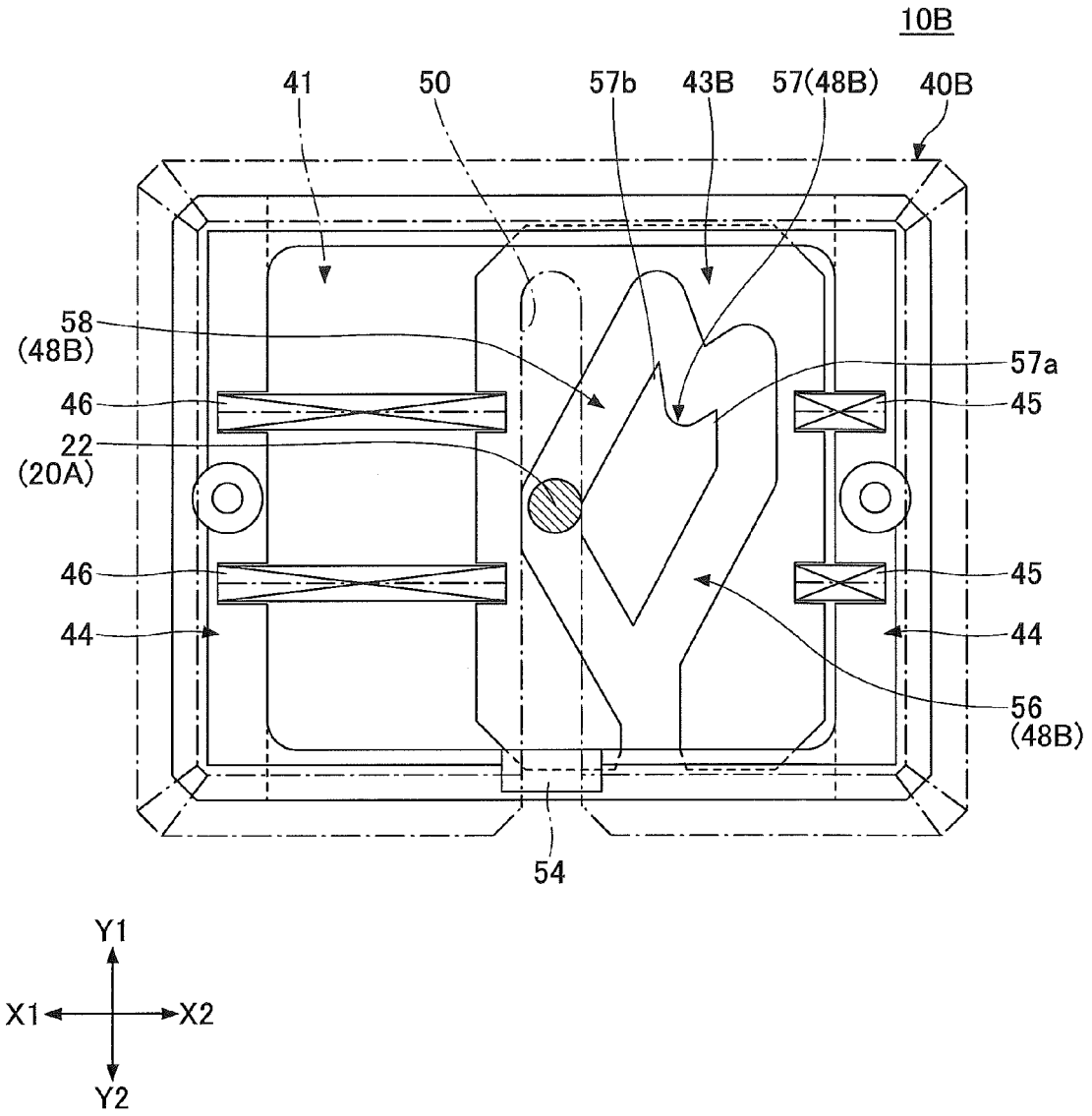
FIG. 10 is a diagram for describing the motion of the door stopper according to the second embodiment of the present invention.

In order to release this locked state and close the door 1, similar to the first embodiment, the door 1 makes a motion in the opening direction for the second time. Accordingly, the rod 22 passes the return pathway side end part 57*b*, and the engagement between the rod 22 and the engagement part 57 (rod locking mechanism 40A) is released. Furthermore, accordingly, by the cam member 43A being biased to move in the X2 arrow direction by the cam spring 46, the rod 22 proceeds to the return pathway 58. FIG. 10 illustrates a state where the rod 22 moves inside the return pathway 58 in the Y2 arrow direction.

As the door 1 is moved in the closing direction (A2 direction), the rod 22 eventually returns to the rod entering part 54 illustrated in FIG. 7, and then separates from a rod locking mechanism 40B. Accordingly, the series of locking motions of the door 1 by the door stopper 10B are ended.

In the door stopper 10B according to the present embodiment, the enter pathway 56, the engagement part 57, and the return pathway 58 can have the same height, and therefore the manufacturing of the cam member 43B can be simplified. Furthermore, the coil spring 24 is not needed in the rod mechanism 20A, and therefore the number of components of the rod mechanism 20A can be reduced.

Figure 11A:
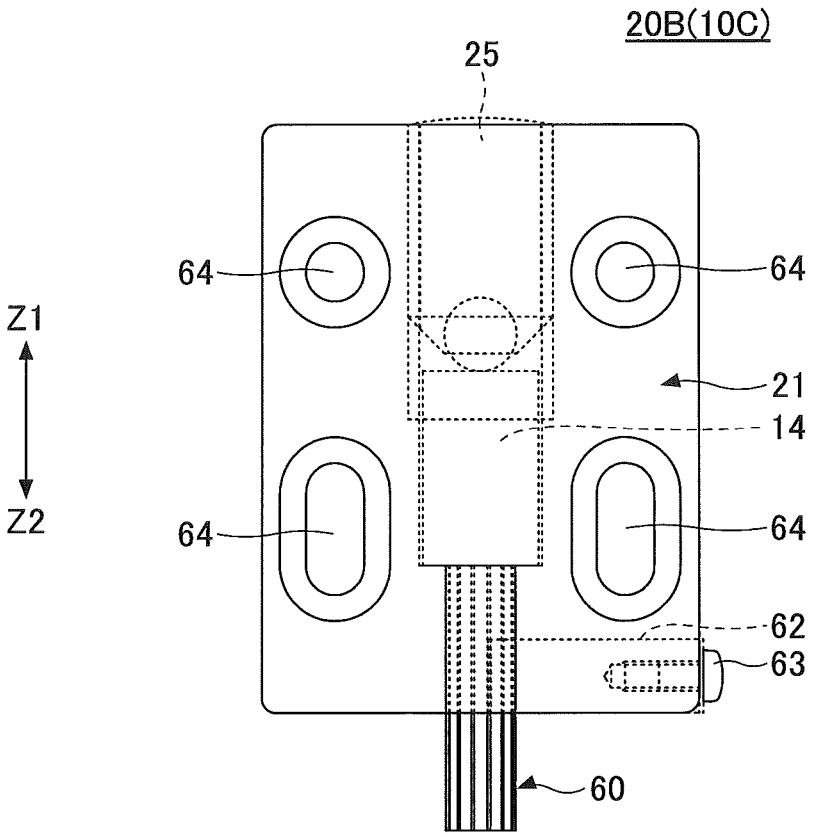
FIG. 11A is a front view of a rod mechanism constituting the door stopper according to a third embodiment of the present invention.
Figure 11B:
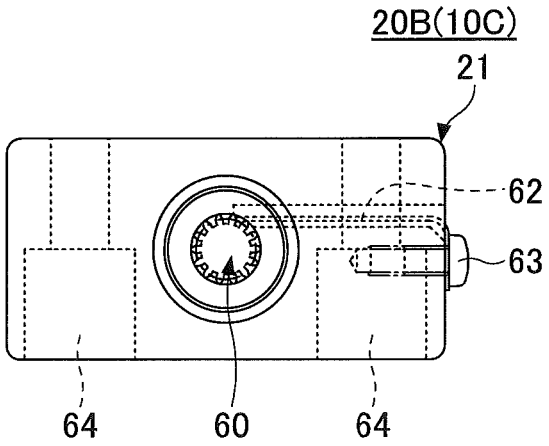
FIG. 11B is a bottom surface view of the rod mechanism constituting the door stopper according to the third embodiment of the present invention.
Figure 12:
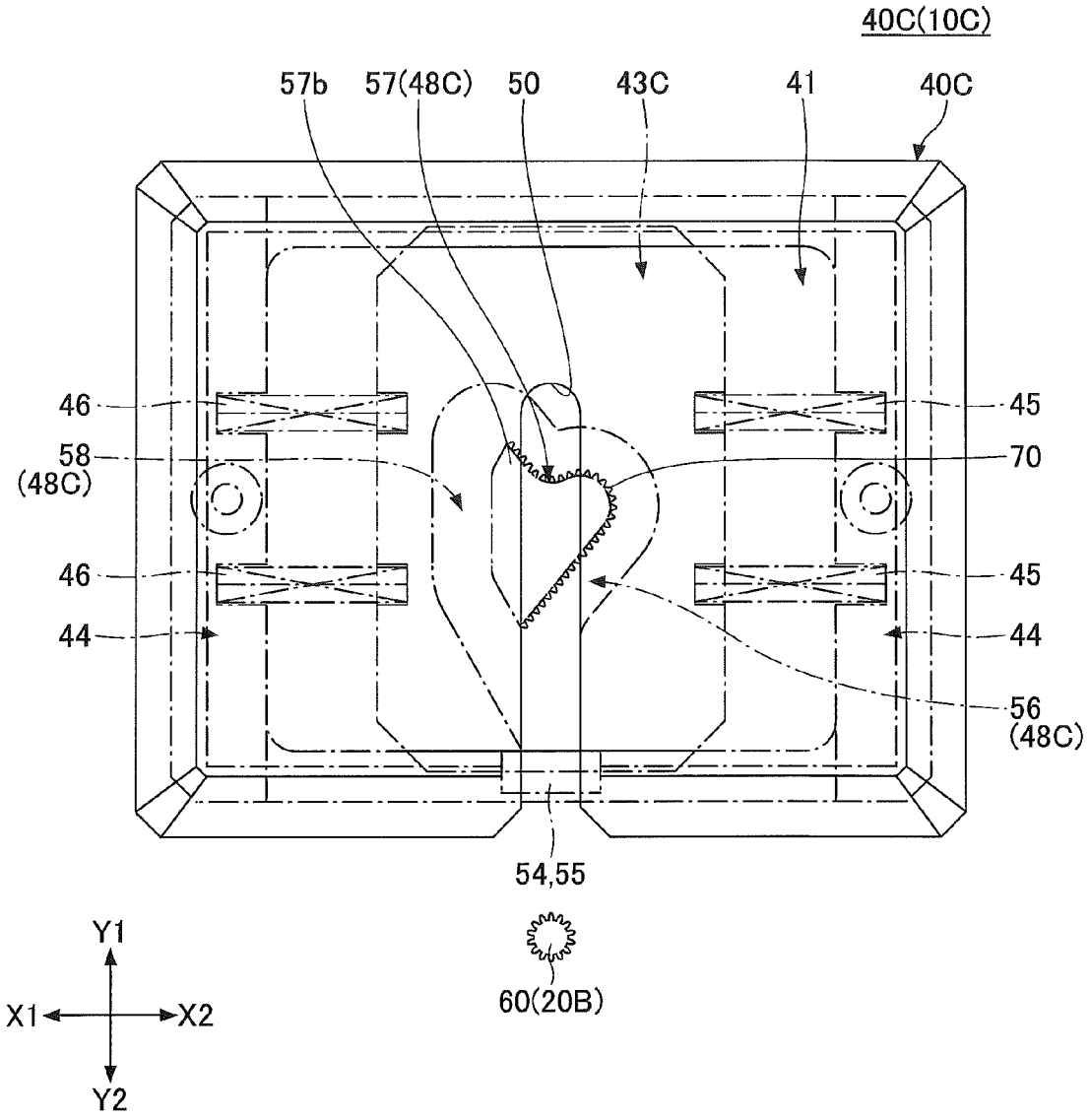
FIG. 12 is a plan view of a rod locking mechanism constituting the door stopper according to the third embodiment of the present invention.

FIG. 11A, FIG. 11B, and FIG. 12 are diagrams for describing a door stopper 10C according to a third embodiment.

The door stopper 10A according to the first embodiment described above indicates a configuration in which the rod 22 provided in the rod mechanism 20A is simply a cylindrical rod. Meanwhile, the door stopper 100 according to the present embodiment is characterized in that the rod is a ratchet rod 60.

FIG. 11A, FIG. 11B, and FIG. 12 illustrate a rod mechanism 20B. The rod mechanism 20B is provided with the ratchet rod 60. The ratchet rod 60 has a pinion structure, and is rotatably arranged in the case 21.

Furthermore, a plate spring 62 is fixed to the case 21 with a fixing screw 63. The leading end part of the plate spring 62 is engaged with the gears forming the ratchet rod 60, such that the ratchet rod 60 is only allowed to rotate in one direction.

Note that in FIG. 11A and FIG. 11B, a reference numeral 64 denotes an attachment hole through which a fixing screw is inserted, when fixing the rod mechanism 20B to the door 1.

FIG. 12 illustrates a rod locking mechanism 40C. The door stopper 100 according to the present embodiment also includes a substantially heart-shaped rod pathway 48C, as a cam member 43C (locking member). Among the rod entering part 55, the enter pathway 56, the engagement part 57, and the return pathway 58, which are formed in the cam member 43C, along the inside perimeter of the enter pathway 56 and the engagement part 57, there are formed gear parts 70 constituting a rack.

The module of the ratchet rod 60 and the module of the gear parts 70 are set to be equal. Furthermore, the width of the paths between the gear parts 70 is set to be slightly greater than the rod diameter, such that the gear parts 70 and the ratchet rod 60 do not become unmeshed. Thus, the ratchet rod 60 and the gear part 70 form a rack pinion mechanism. Furthermore, as described above, the ratchet rod 60 is only allowed to rotate in one direction by the plate spring 62, and therefore the ratchet rod 60 and the gear part 70 also function as a ratchet mechanism.

In the door stopper 10C according to the present embodiment, when the ratchet rod 60 moves inside the enter pathway 56, the ratchet rod 60 and the gear part 70 mesh with each other, and the ratchet rod 60 moves toward the engagement part 57 while rotating.

As described above, the ratchet rod 60 and the gear part 70 constitute a ratchet mechanism. Additionally, the rotation direction of the ratchet rod 60 is set to be allowed only in the direction in which the ratchet rod 60 moves toward the engagement part 57. Therefore, the ratchet rod 60 can be prevented from moving in the returning direction. Accordingly, in the present embodiment also, the height of the rod entering part 55, the enter pathway 56, the engagement part 57, and the return pathway 58 can be set to be equal.

FIG. 13, FIG. 14A, FIG. 14B, FIGS. 15A through 15C, FIGS. 16D through 16F, FIG. 17A, and FIG. 17B illustrate a door stopper 10D according to a fourth embodiment.

The door stopper 10D according to the present embodiment also includes a substantially heart-shaped rod pathway 48D as a cam member 43D (locking member), and the rod 22 and the cam member 43D constitute a cam mechanism. Note that in the respective figures used for describing the door stopper 10D according to the present embodiment, in the rod mechanism 20A, only the rod 22 is illustrated.

In the respective embodiments described above, the cam springs 45, 46 are provided, and therefore before the rod 22 enters inside the rod locking mechanism 40A through 40C, the cam member 43A through 43C is in a still state at a center position.

Therefore, when the rod 22 enters inside the rod locking mechanism 40A through 40C from the rod entering part 54, the rod 22 immediately engages with the rod pathway 48A through 48C.

Meanwhile, the door stopper 10D according to the present embodiment is characterized in that a rod insertion guide unit 80 is provided in the cam member 43D, and therefore the cam springs 45, 46 are needless. In the following, a description is given of the configuration of the door stopper 10D according to the present embodiment.

The rod insertion guide unit 80 is formed on the side (Y2 arrow side) facing the rod entering part 54 of the cam member 43D. This rod insertion guide unit 80 is constituted by a pair of guide surfaces 81, 82. Furthermore, the part between the pair of guide surfaces 81, 82 constitutes the rod entering part 55.

The rod insertion guide unit 80 has a function of guiding the rod 22 that has proceeded to the rod entering part 55 from the rod entering part 54, to a rod pathway end part P of the rod pathway 48D. Thus, the end part of the rod insertion guide unit 80 (guide surfaces 81, 82) in the Y1 arrow direction side in the diagram is continuously connected to the rod pathway 48D.

The rod insertion guide unit 80 has a sector shape that spreads out toward the rod entering part 54 side from the pivot on the rod pathway end part P side in a planar view (state illustrated in FIG. 3). Specifically, the guide surface 81 forms a slope surface spreading out from the rod pathway end part P toward the rod entering part 54 side in the X2 arrow direction side in the drawing, and the guide surface 82 forms a slope surface spreading out from the rod pathway end part P toward the rod entering part 54 side in the X1 arrow direction side in the drawing.

Furthermore, each of the guide surfaces 81, 82 constituting the rod insertion guide unit 80 is constituted by a wall surface standing up with respect to the rod entering part 55. Therefore, when the rod 22 proceeds inside the rod locking mechanism 40D and engages with the guide surface 81 or the guide surface 82, the rod 22 proceeds toward the rod pathway end part P by being guided by the guide surface 81 or the guide surface 82. Note that as a matter of convenience in the description, the guiding of the rod 22 by the rod insertion guide unit 80 is described below.

As described above, in the present embodiment, the rod locking mechanism 40D does not include a cam spring. Therefore, the cam member 43D is freely movable in the X1, X2 arrow direction inside the cam holder 44.

Therefore, in a state where the rod 22 has not proceeded inside the rod locking mechanism 40D, the position of the cam member 43D is not determined. That is, the cam member 43D is positioned at either one of the position reached by moving to the end part in the X2 arrow direction illustrated in FIG. 14A, or the position reached by moving to the end part in the X1 arrow direction illustrated in FIG. 14B.

Figure 13:
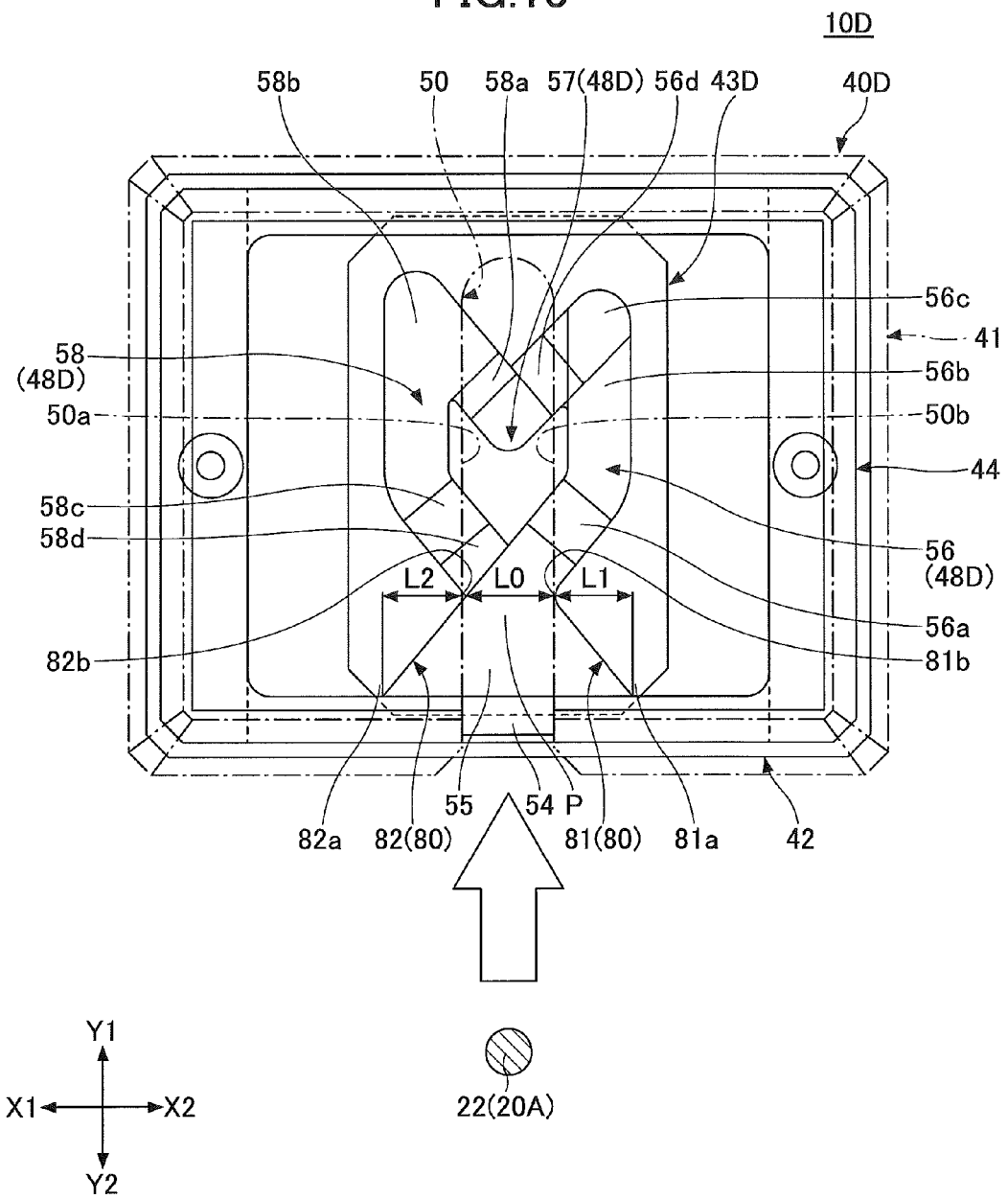
FIG. 13 is a plan view of a rod locking mechanism constituting a door stopper according to a fourth embodiment of the present invention.

Incidentally, when the rod 22 enters the rod locking mechanism 40D, the rod 22 is guided by the rod insertion groove 50 formed in the cam cover 41, in a substantially linear manner in the Y1 arrow direction. Supposing that, as illustrated in FIG. 13, the cam member 43D is positioned at a center position with respect to the X1, X2 arrow direction inside the rod locking mechanism 40D, the rod insertion groove 50 and the rod pathway end part P face each other (in a state where the rod pathway end part P is positioned on the proceeding path of the rod 22).

Thus, when the rod 22 proceeds in the Y1 arrow direction from the free state, the rod 22 smoothly proceeds to the rod pathway 48D via the rod pathway end part P. Therefore, when the cam member 43D is at the center position, even when the rod insertion guide unit 80 is provided, the motions of the rod 22 and the cam member 43D do not largely change from those of the first embodiment described above.

Figure 14A:
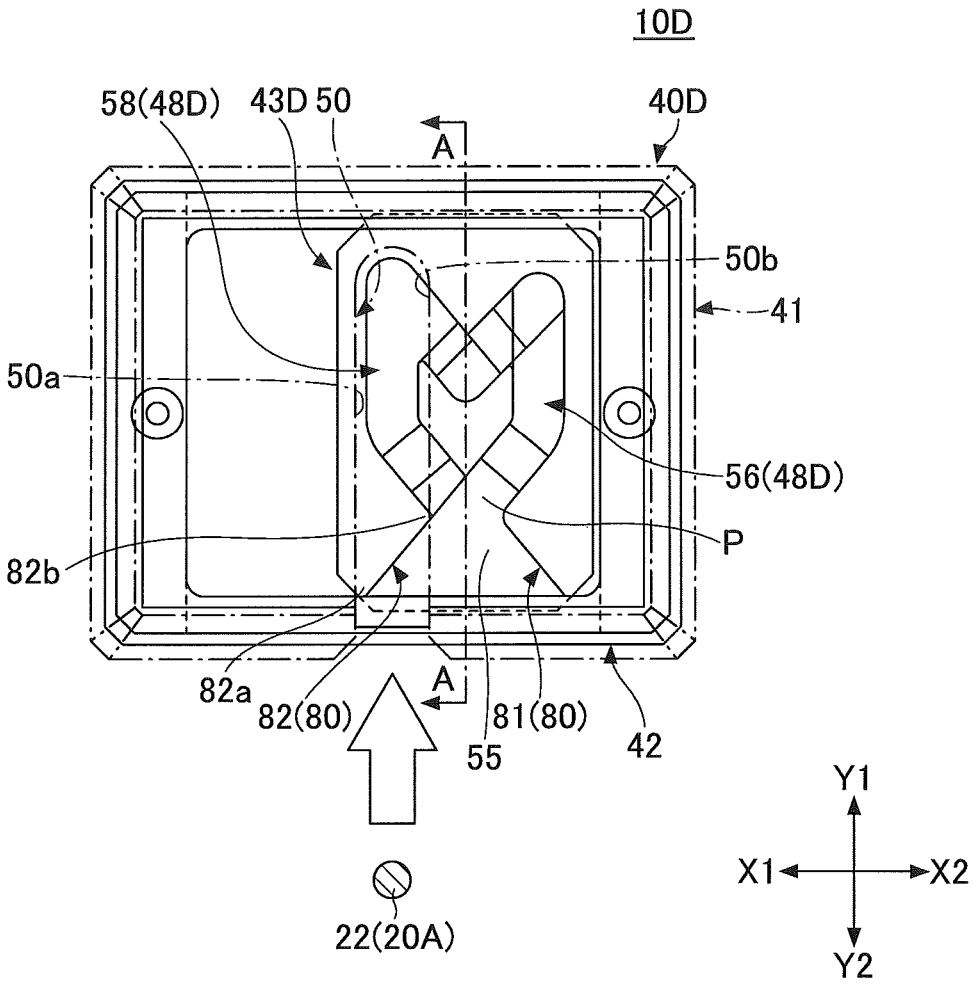
FIG. 14A is a plan view of a state where a cam member has moved to a X2 arrow direction side, in the rod locking mechanism constituting the door stopper according to the fourth embodiment of the present invention.
Figure 14B:
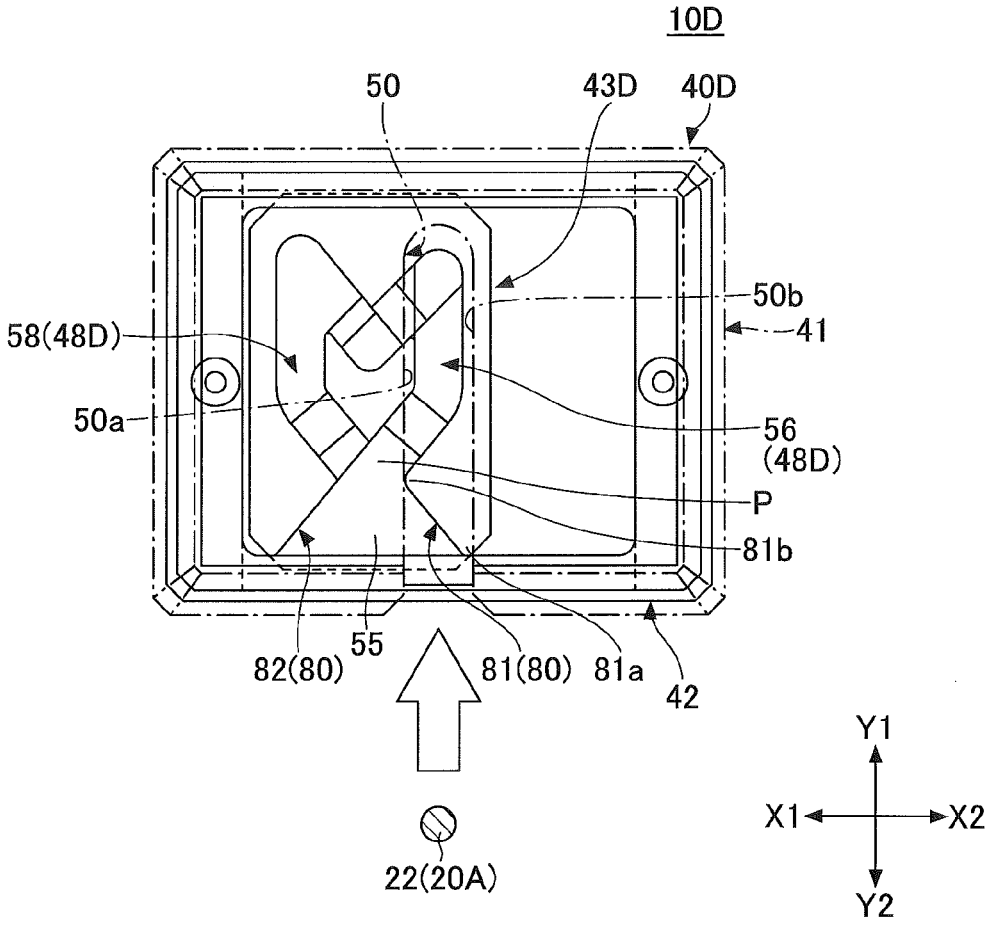
FIG. 14B is a plan view of a state where a cam member has moved to a X1 arrow direction side, in the rod locking mechanism constituting the door stopper according to the fourth embodiment of the present invention.

Meanwhile, for example, as illustrated in FIG. 14A, FIG. 14B, in a state where the cam member 43D is not positioned at the center position, the rod pathway end part P is deviated from the rod insertion groove 50. That is, the rod pathway end part P does not exist on the proceeding path of the rod 22.

However, the door stopper 10D according to the present embodiment has a configuration in which regardless of the movement position of the cam member 43D, the rod insertion guide unit 80 faces the rod insertion groove 50. Specifically, when the cam member 43D is positioned between the center position illustrated in FIG. 13 and the X1 arrow direction end part illustrated in FIG. 14B, the guide surface 81 of the rod insertion guide unit 80 faces the rod insertion groove 50.

Furthermore, when the cam member 43D is positioned between the center position illustrated in FIG. 13 and the X2 arrow direction end part illustrated in FIG. 14A, the guide surface 82 of the rod insertion guide unit 80 faces the rod insertion groove 50.

The distance between a guide surface end part 81*a* of the guide surface 81 and a rod pathway end part side end part 81*b* in the X1, X2 arrow direction (indicated by arrow L1 in FIG. 13) is set to be the same as the width of the rod insertion groove 50 in the X1, X2 arrow direction (indicated by arrow L0 in FIG. 13), or larger than the width L0 (L1≥L0). Similarly, the distance between a guide surface end part 82*a* of the guide surface 82 and a rod pathway end part side end part 82*b* in the X1, X2 arrow direction (indicated by arrow L2 in FIG. 13) is set to be the same as the width L0 of the rod insertion groove 50 in the X1, X2 arrow direction, or larger than the width L0 (L2≥L0).

Furthermore, as illustrated in FIG. 14A, in a state where the cam member 43D has moved to the X2 arrow direction end part, the guide surface end part 82*a* of the guide surface 82 is positioned substantially below a side wall 50*a* in the X1 arrow direction side of the rod insertion groove 50, and the rod pathway end part side end part 82*b* is positioned substantially below a side wall 50*b* in the X2 arrow direction side of the rod insertion groove 50.

Furthermore, as illustrated in FIG. 14B, in a state where the cam member 43D has moved to the X1 arrow direction end part, the guide surface end part 81*a* of the guide surface 82 is positioned substantially below a side wall 50*b* in the X2 arrow direction side of the rod insertion groove 50, and the rod pathway end part side end part 81*b* is positioned substantially below a side wall 50*a* in the X1 arrow direction side of the rod insertion groove 50.

Thus, in the door stopper 10D according to the present embodiment having the above configuration, regardless of the movement position of the cam member 43D, at least one of the rod insertion guide unit 80 and the rod pathway end part P faces the rod insertion groove 50. Therefore, when the rod 22 is guided by the rod insertion groove 50 and proceeds inside the rod locking mechanism 40D in the Y1 arrow direction, the rod 22 directly proceeds to the rod pathway end part P, or comes in contact with either one of the guide surface 81 or the guide surface 82 constituting the rod insertion guide unit 80.

Next, with reference to FIGS. 15A through 15F, a description is given of motions of the door stopper 10D according to the present embodiment having the above configuration.

Note that FIGS. 15A through 15F illustrate the motion of the cam member 43D when the rod 22 proceeds to the rod locking mechanism 40D, in a state where the cam member 43D is positioned at the end part in the X2 arrow direction in FIG. 14A. Furthermore, as a matter of convenience in illustration and description, in FIGS. 15A through 15F, with respect to the rod mechanism 20A, only the rod 22 is illustrated, and with respect to the rod locking mechanism 40D, the cam cover 41 is omitted from being illustrated.

Figure 15A:
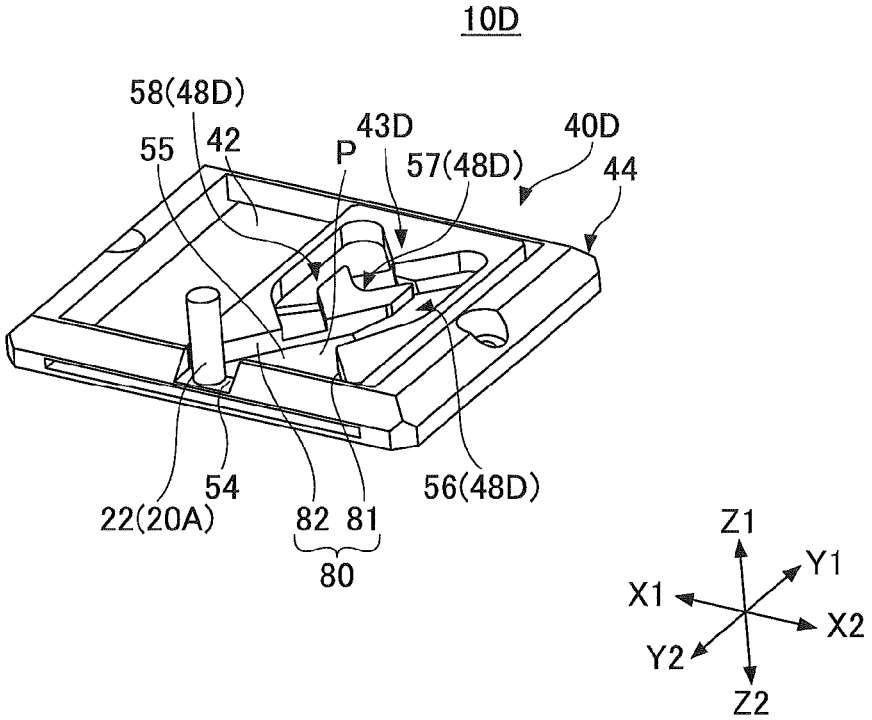
FIG. 15A is a diagram for describing the motion of the door stopper according to the fourth embodiment of the present invention.

As described above, in a state where the cam member 43D is positioned at the end part in the X2 arrow direction, the guide surface 82 of the rod insertion guide unit 80 is facing the rod insertion groove 50. In this state, FIG. 15A illustrates a state where the rod 22 is positioned at the rod entering part 54 of the rod locking mechanism 40D, by the motion of the door 1 in the opening direction for the first time (free state).

When the door 1 is moved in the opening direction from the free state, the rod 22 engages with the guide surface 82 of the rod insertion guide unit 80, and by further moving the door 1 in the Y1 arrow direction, the rod 22 biases the cam member 43D via the guide surface 82.

As described above, as the guide surface 82 is a slope surface, the force of the rod 22 moving in the Y1 arrow direction is divided into the component forces of a force in the Y1 arrow direction and a force in the X1 arrow direction. Furthermore, in the cam holder 44, the cam member 43D can freely move in the X1, X2 arrow direction in the figure. Therefore, by the component force in the X1 arrow direction described above, the cam member 43D moves in the X1 arrow direction inside the cam holder 44.

Figure 15B:
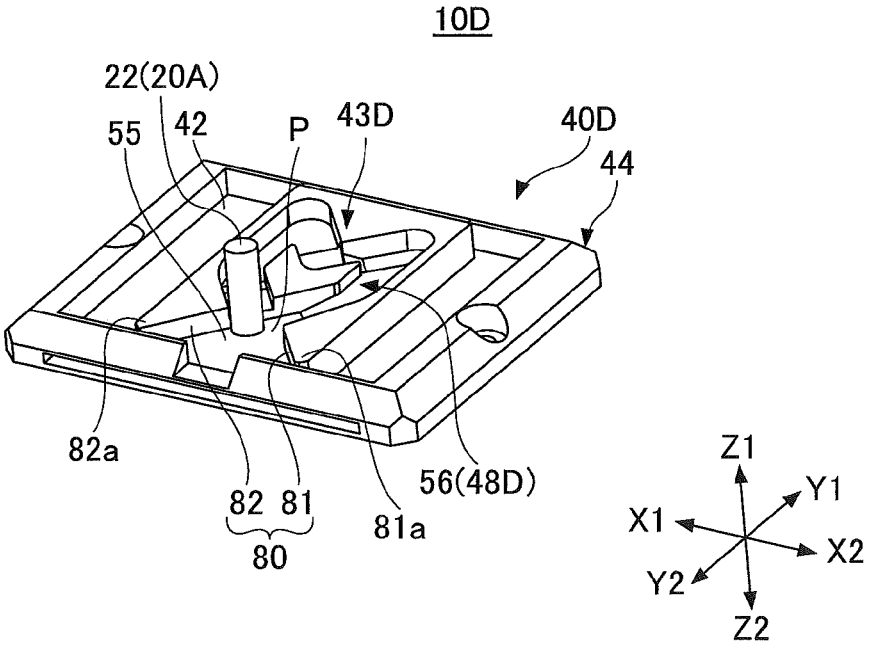
FIG. 15B is a diagram for describing the motion of the door stopper according to the fourth embodiment of the present invention.

Furthermore, as the cam member 43D moves in the X1 arrow direction, the rod 22 is allowed to move in the Y1 arrow direction. Thus, after the rod 22 contacts the guide surface 82, the rod 22 is guided by the rod insertion groove 50 and the guide surface 82 and continues to move in the Y1 arrow direction on the rod entering part 55, and the rod 22 eventually reaches the rod pathway end part P. FIG. 15B illustrates a state where the rod 22 has proceeded to the rod pathway end part P.

Figure 15C:
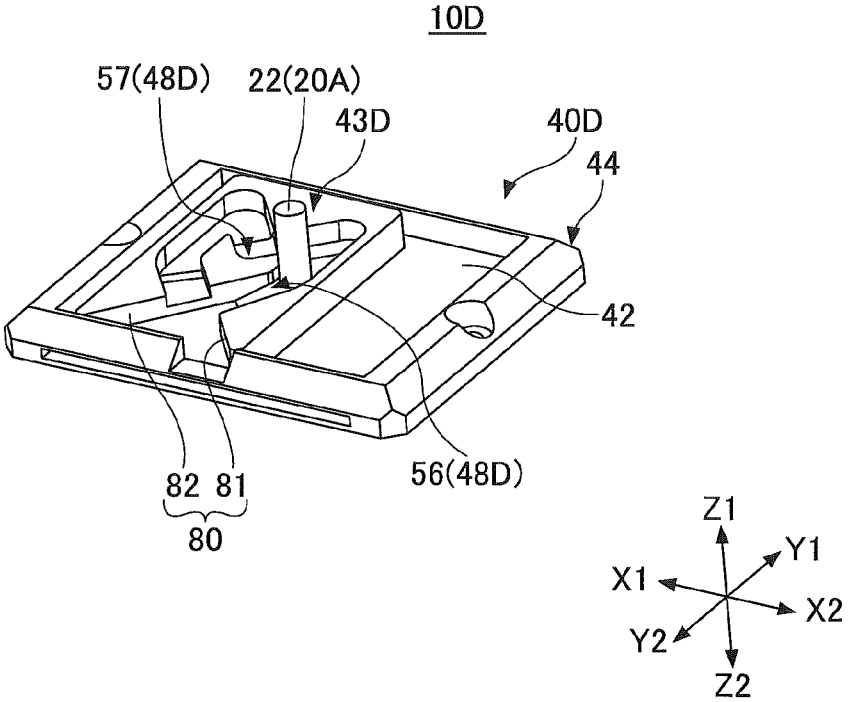
FIG. 15C is a diagram for describing the motion of the door stopper according to the fourth embodiment of the present invention.

When the rod 22 further moves in the Y1 arrow direction, as illustrated in FIG. 15C, the rod 22 proceeds to the enter pathway 56 of the rod pathway 48D. FIG. 15C illustrates a state where the rod 22 has climbed the rising surface part 56*a* of the rod pathway 48D and has proceeded to the plain surface part 56*b*.

Figure 15D:
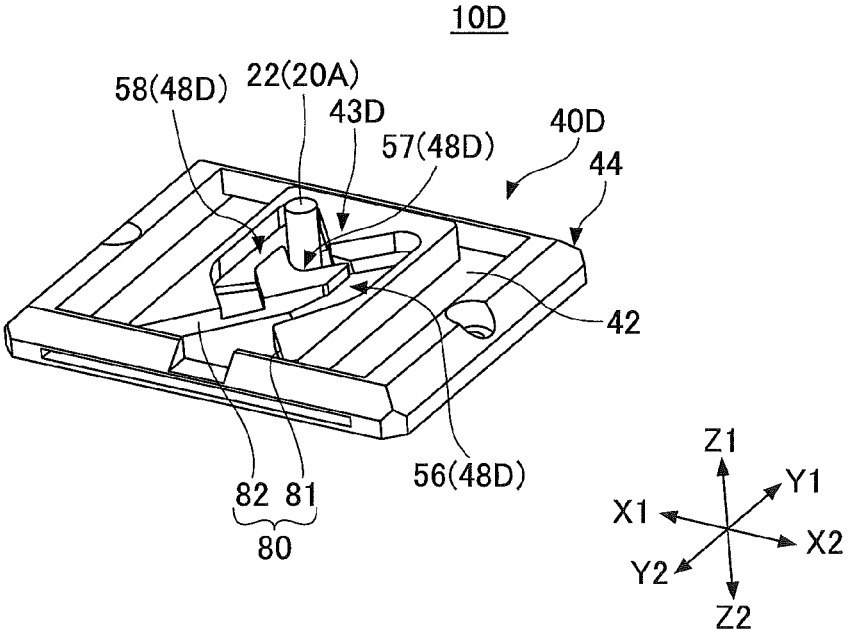
FIG. 15D is a diagram for describing the motion of the door stopper according to the fourth embodiment of the present invention.

When the rod 22 further proceeds in the Y1 arrow direction from the state illustrated in FIG. 15C, the rod 22 falls into the recessed surface part 56*c* from the plain surface part 56*b*, and subsequently climbs the rising surface part 56*d*, such that the rod 22 engages with the engagement part 57. Thus, the rod 22 turns into a locked state, and even when a force is applied in the closing direction (Y2 arrow direction), the door 1 maintains an open state. FIG. 15D illustrates a state where the rod 22 and the engagement part 57 are engaged.

In the present embodiment also, in order to release the locked state and close the door 1, the motion of the door 1 in the opening direction is made for the second time (the motion of moving the door 1 in the opening direction).

Figure 15E:
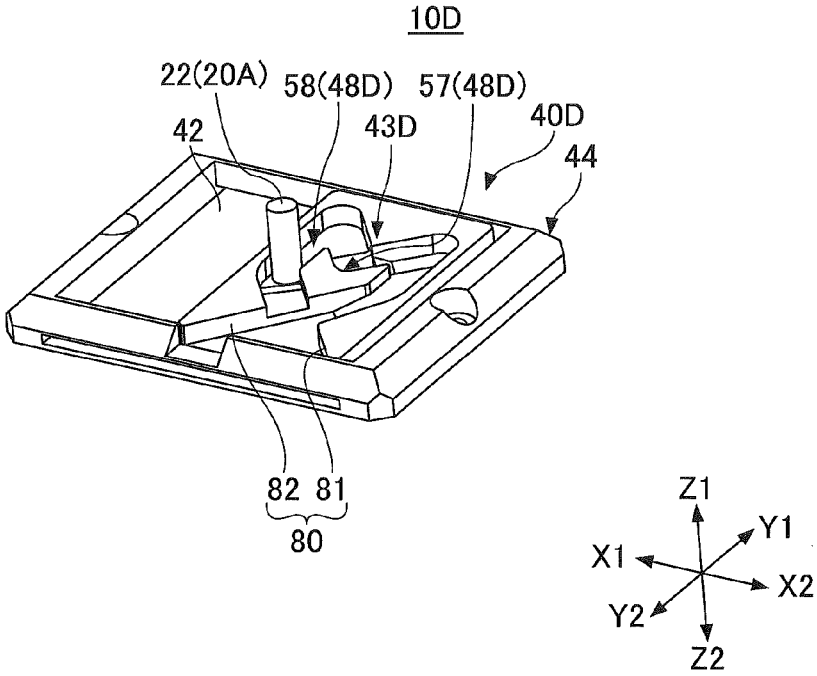
FIG. 15E is a diagram for describing the motion of the door stopper according to the fourth embodiment of the present invention.

By this motion in the opening direction for the second time, the rod 22 proceeds to the return pathway 58. As described above, when closing the door 1, a force in the closing direction (direction indicated by arrow A2 in FIG. 1) is loaded on the door 1. This force is also loaded on the rod 22, and therefore the rod 22 moves in the Y2 arrow direction inside the return pathway 58. FIG. 15E illustrates a state where the rod 22 is moving the Y2 arrow direction inside the return pathway 58.

Figure 15F:
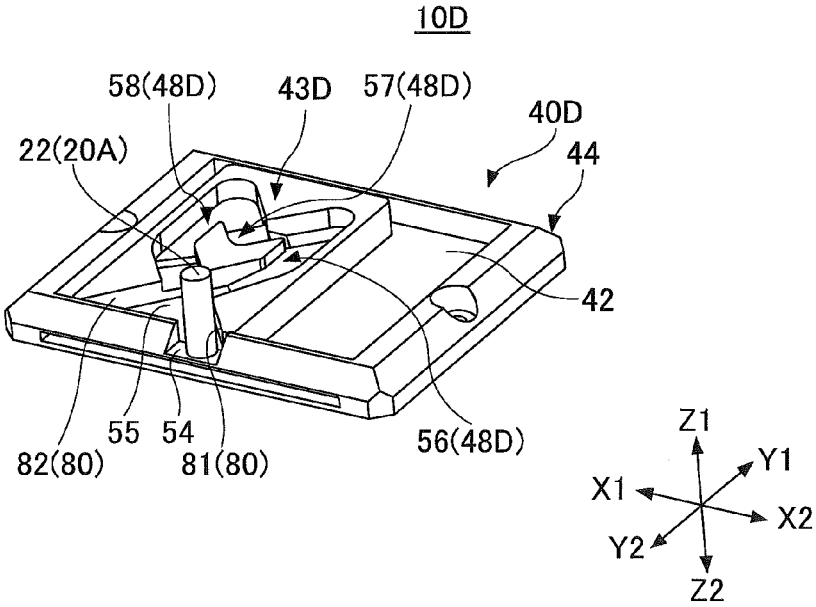
FIG. 15F is a diagram for describing the motion of the door stopper according to the fourth embodiment of the present invention.

Note that when the rod 22 moves in the Y1, Y2 arrow direction along the rod insertion groove 50, the cam member 43D is biased by the rod 22, and moves in the X1, X2 arrow direction according to the shape of the rod pathway 48D. Then, in a state where the rod 22 has moved close to the rod entering part 54, as illustrated in FIG. 15F, the cam member 43A moves to a substantially center position, and the rod entering part 54 and the rod entering part 55 become communicated with each other.

Thus, as the rod 22 further moves in the Y2 arrow direction, the rod 22 (rod mechanism 20A) separates from the rod locking mechanism 40D. Accordingly, the series of locking motions of the door 1 by the door stopper 10D are ended.

Note that the motion of the rod 22 entering the rod locking mechanism 40D in a state where the cam member 43D is positioned at the end part in the X1 arrow direction as illustrated in FIG. 14B, is the same as the motion described above except for the point that the rod 22 reaches the rod pathway end part P by being guided by the guide surface 81 of the rod insertion guide unit 80, and therefore a description thereof is omitted.

Furthermore, when the rod 22 enters the rod locking mechanism 40D in a state where the cam member 43D is positioned at the center position as illustrated in FIG. 13, the rod 22 directly proceeds to the rod pathway end part P without being guided by the rod insertion guide unit 80, and therefore the description thereof is also omitted.

As described above, in the door stopper 10D according to the present embodiment, the rod 22 can be locked and released from being locked without using the cam springs 45, 46. Thus, by the door stopper 10D according to the present embodiment, the number of components of the door stopper 10D can be reduced and the assembly operation can be made easier.

Incidentally, unlike the other embodiments in which the cam springs 45, 46 are used to forcibly move the cam member 43A through 43C to the center position, in the door stopper 10D according to the present embodiment, the cam member 43D is moved in the X1, X2 arrow direction by the movement of the rod 22 in the Y1, Y2 arrow direction. Therefore, the door stopper 10D according to the present embodiment includes upper protruding parts 49A and lower protruding parts 49B provided in the cam member 43A.

Figure 16A:
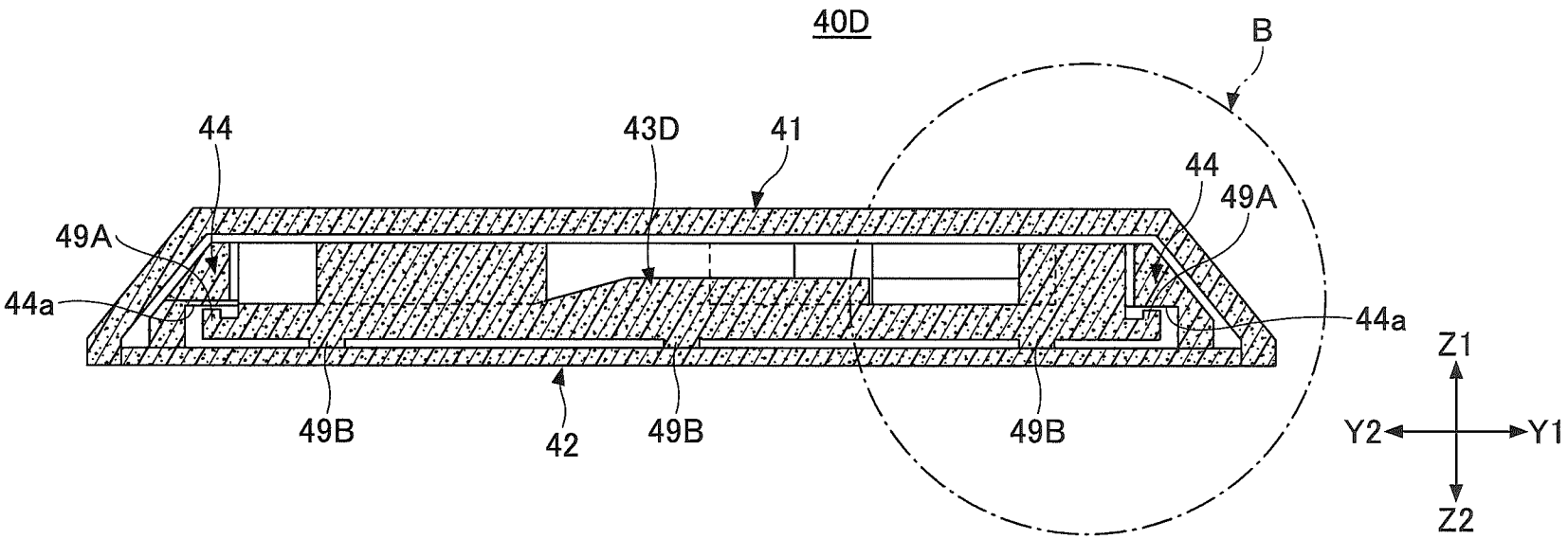
FIG. 16A is a cross-section cut along a line A-A in FIG. 14A.
Figure 16B:
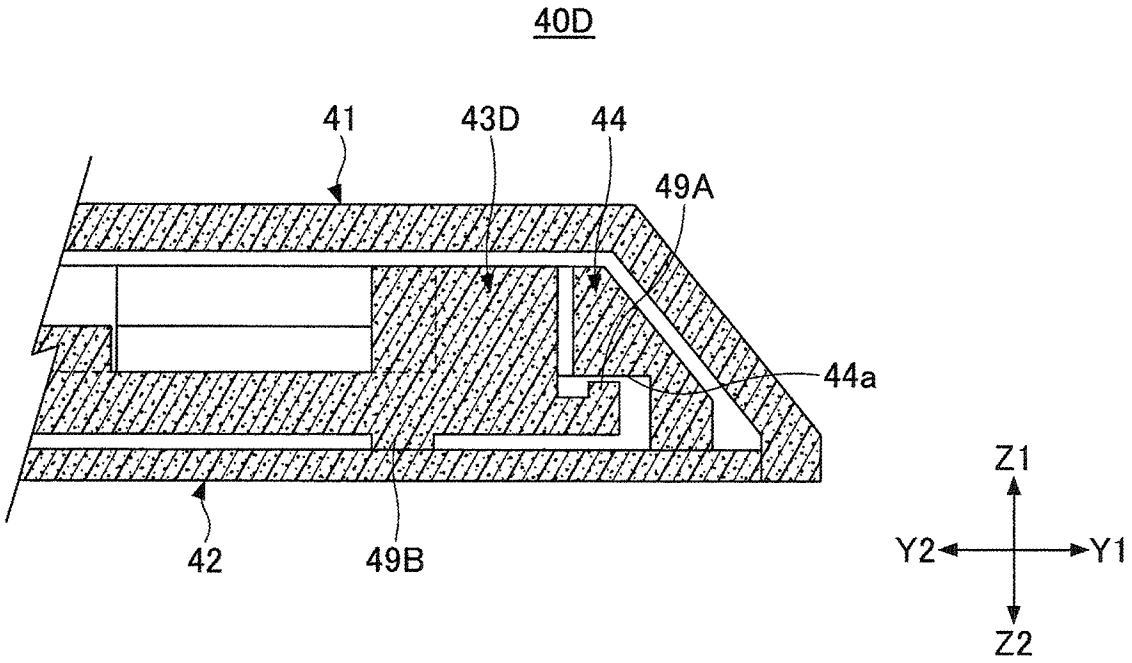
FIG. 16B is an enlargement of the inside of the circle drawn by a dashed-dotted line indicated by an arrow B in FIG. 16A.

FIGS. 16A and 16B illustrate the upper protruding part 49A and the lower protruding part 49B. FIG. 16A is a cross-section cut along a line A-A in FIG. 14A, and FIG. 16B is an enlargement of the inside of the circle indicated by an arrow B in FIG. 16A.

The upper protruding part 49A is formed to protrude toward the top of the side rim part of the cam member 43A on the Y1 arrow direction side and the side rim part of the cam member 43A on the Y2 arrow direction side (in the Z1 arrow direction). The upper protruding part 49A is not formed on the entirety of both side rims of the cam member 43A extending in the X1, X2 arrow direction, but a plurality of upper protruding parts 49A are formed with predetermined intervals.

Furthermore, at a position facing the upper protruding part 49A of the cam holder 44, there is formed a slide surface 44*a*. Thus, when the cam member 43D moves in the X1, X2 arrow direction, the upper protruding part 49A slides along the slide surface 44*a*.

Here, a plurality of upper protruding parts 49A are formed with predetermined intervals as described above, and therefore compared to a configuration in which the entirety of the side rim part of the cam member 43D contacts the slide surface 44*a*, in the present embodiment, the contact area of the upper protruding parts 49A and the slide surface 44*a* is small. Accordingly, the friction generated between the upper protruding part 49A and the slide surface 44*a* can be reduced.

Furthermore, the lower protruding part 49B is formed to protrude toward the base 42, on the bottom surface part of the cam member 43D. Also in the case of the lower protruding part 49B, a plurality of lower protruding parts 49B are formed with predetermined intervals. The lower protruding parts 49B may be arranged in, for example, a lattice form as viewed from the bottom surface; however, the present embodiment is not so limited.

As described above, also by the lower protruding parts 49B that are formed with predetermined intervals on the bottom surface of the cam member 43D, the contact area of the lower protruding part 49B and the base 42 can be made smaller compared to that of a configuration in which the entirety of the bottom surface of the cam member 43D contacts the base 42.

Furthermore, by providing the upper protruding part 49A and the lower protruding part 49B, the friction generated between the cam member 43D and the base 42 and the cam holder 44 can be reduced, and the movement of the cam member 43D in the X1, X2 arrow direction can be smoothly performed. Thus, even in a configuration in which the cam springs 45, 46 are not provided, the movement of the cam member 43D can be smoothened, and the locking and the releasing of the locking of the door 1 can be surely performed.

As described above, a detailed description is given of preferred embodiments of the present invention; however, the present invention is not limited to the specific embodiments described above, and variations and modifications may be made without departing from the scope of the present invention described in the claims.

The present international application claims priority from Japanese Patent Application No. 2013-040394 filed on Mar. 1, 2013, and Japanese Patent Application No. 2013-110072 filed on May 24, 2013, the entire contents of Japanese Patent Application No. 2013-040394 and Japanese Patent Application No. 2013-110072 are hereby incorporated by reference in the present international application.

The invention claimed is:

1. A door stopper comprising:

a rod mechanism attached to a door, the rod mechanism being provided with a rod extending toward a floor; and a rod locking mechanism provided on the floor, the rod locking mechanism being configured to lock the door in an open state by locking the rod, wherein the rod locking mechanism includes a locking member holder; and a locking member that is disposed in the locking member holder, and is moveable within the locking member holder in a lateral direction that is parallel to a floor surface, the locking member being configured to lock a movement of the rod by engaging with the rod according to a motion of the door in an opening direction for a first time, and to allow a movement of the rod in a closing direction of the door by releasing the engagement with the rod according to a motion of the door in the opening direction for a second time, wherein the locking member holder includes a rod entering opening through which the rod enters the locking member holder;

the locking member includes a pathway through which the rod passes, and a rod insertion guide that is provided at an entrance of the pathway and guides the rod to the pathway; and the rod insertion guide is configured to face the rod entering opening of the locking member holder regardless of a movement position of the locking member in the lateral direction.

2. The door stopper according to claim 1, wherein the rod locking mechanism includes a locking member biasing means configured to bias the locking member to a center position within the locking member holder.

3. The door stopper according to claim 1, wherein the rod mechanism includes a rod biasing means configured to support the rod so as to be movable in a vertical direction with respect to the floor surface, and bias the rod toward the floor.

4. A rod locking mechanism for locking a door in an open state by locking a rod provided on the door and extending toward a floor, the rod locking mechanism comprising:

a locking member holder; and a locking member that is disposed in the locking member holder, and is moveable within the locking member holder in a lateral direction that is parallel to a floor surface, the locking member being configured to lock a movement of the rod by engaging with the rod according to a motion of the door in an opening direction for a first time, and to allows to allow a movement of the rod in a closing direction of the door by releasing the engagement with the rod according to a motion of the door in the opening direction for a second time, wherein the locking member holder includes a rod entering opening through which the rod enters the locking member holder;

the locking member includes a pathway through which the rod passes, and a rod insertion guide that is provided at an entrance of the pathway and guides the rod to the pathway; and the rod insertion guide is configured to face the rod entering opening of the locking member holder regardless of a movement position of the locking member in the lateral direction.

* * * * *